US011386827B1

(12) United States Patent
Jang et al.

(10) Patent No.: US 11,386,827 B1
(45) Date of Patent: Jul. 12, 2022

(54) LEVEL SHIFTER AND DISPLAY DEVICE

(71) Applicant: LG Display Co., Ltd., Seoul (KR)

(72) Inventors: Hoon Jang, Paju-si (KR); Soondong Cho, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/458,118

(22) Filed: Aug. 26, 2021

(30) Foreign Application Priority Data

Dec. 24, 2020 (KR) ..... 10-2020-0183579

(51) Int. Cl.
*G09G 3/20* (2006.01)

(52) U.S. Cl.
CPC ..... *G09G 3/20* (2013.01); *G09G 2310/0289* (2013.01); *G09G 2310/08* (2013.01)

(58) Field of Classification Search
CPC ..... G09G 2310/0289; G09G 2310/08
See application file for complete search history.

(56) References Cited

U.S. PATENT DOCUMENTS

2018/0033381 A1 2/2018 Hwang et al.
2018/0090095 A1 3/2018 Jeon et al.
2020/0020280 A1 1/2020 Han et al.
2020/0335059 A1* 10/2020 Zheng ..... G09G 3/2074
2020/0335060 A1* 10/2020 Xiao ..... G09G 3/20
2020/0335532 A1* 10/2020 Umezaki ..... G11C 19/184

FOREIGN PATENT DOCUMENTS

KR 10-2017-0015728 A 2/2017
KR 10-1869421 B1 7/2018

* cited by examiner

*Primary Examiner* — Sejoon Ahn
(74) *Attorney, Agent, or Firm* — Fenwick & West LLP

(57) ABSTRACT

Embodiments of the present disclosure relate to a level shifter and a display device capable of differently controlling a signal waveform between a first clock signal and a second clock signal used to output a first gate signal and a second gate signal. Accordingly, it is possible to reduce the variation in output characteristics between the first gate signal and the second gate signal, thereby improving image quality.

20 Claims, 31 Drawing Sheets

CLK1 ~ CLK 8 { Odd Clock signals: CLK1, CLK3, CLK5, CLK7
Even Clock Signals: CLK2, CLK4, CLK6, CLK8 }

LEVEL SHIFTER AND DISPLAY DEVICE

CROSS-REFERENCE TO RELATED APPLICATION

This application claims the benefit and priority from Republic of Korea Patent Application No. 10-2020-0183579, filed in the Republic of Korea on Dec. 24, 2020, which is hereby incorporated by reference in its entirety.

BACKGROUND

Technical Field

The present disclosure relates to a level shifter and a display device.

Description of the Related Art

As the information society develops, demand for a display device for displaying an image is increasing in various forms, and in recent years, various display devices such as a liquid crystal display device and an organic light emitting display device are used.

A conventional display device may charge a capacitor disposed in each of a plurality of sub-pixels arranged on a display panel and use the capacitors to drive the display. However, in the case of a conventional display device, a phenomenon in which charging is insufficient in each sub-pixel may occur, resulting in a problem of deteriorating image quality.

In a conventional display device, if the size of the non-display area of the display panel can be reduced, the degree of freedom in design of the display device can be increased, and design quality can also be improved. However, it is not easy to reduce the non-display area of the display panel because various wires and circuits must be arranged in the non-display area of the display panel.

In addition, in the case of a conventional display device, not only the image quality is degraded due to insufficient charging time, but also the gate driving may malfunction due to the characteristic variation of the gate signals, resulting in deterioration of the image quality.

SUMMARY

Embodiments of the present disclosure provide a level shifter and a display device that can reduce a characteristic variation between gate signals and thereby improve image quality.

Embodiments of the present disclosure provide a level shifter and a display device capable of variously controlling a rising characteristic and/or a falling characteristic of clock signals.

Embodiments of the present disclosure provide a level shifter and a display device capable of reducing the size of an arrangement area of the gate driving circuit and reducing characteristic variation between gate signals even if the gate driving circuit is disposed on the display panel in a panel built-in type.

According to aspects of the present disclosure, there are a level shifter including: a first output terminal outputting a first clock signal; a second output terminal outputting a second clock signal having a different rising length or a different falling length than the first clock signal; a high input terminal to which a high level voltage is input; a low input terminal to which a low level voltage is input; an intermediate input terminal to which an intermediate level voltage is input; a first clock output circuit including a first rising switch for controlling an electrical connection between the high input terminal and the first output terminal, a first falling switch for controlling an electrical connection between the low input terminal and the first output terminal, and a first gate pulse modulation switch for controlling an electrical connection between the intermediate input terminal and the first output terminal; and a second clock output circuit including a second rising switch for controlling an electrical connection between the high input terminal and the second output terminal, a second falling switch controlling an electrical connection between the low input terminal and the second output terminal, and a second gate pulse modulation switch for controlling an electrical connection between the intermediate input terminal and the second output terminal.

A falling length of the first clock signal may be longer than a falling length of the second clock signal.

An on-resistance of the first gate pulse modulation switch when the first clock signal falls may be greater than an on-resistance of the second gate pulse modulation switch when the second clock signal falls.

In another embodiment, an on-resistance of the first falling switch when the first clock signal falls may be greater than an on-resistance of the second falling switch when the second clock signal falls.

A rising length of the second clock signal may be longer than a rising length of the first clock signal.

An on-resistance of the second gate pulse modulation switch when the second clock signal rises may be greater than an on-resistance of the first gate pulse modulation switch when the first clock signal rises.

An on-resistance of the second rising switch when the second clock signal rises may be greater than an on-resistance of the first rising switch when the first clock signal rises.

An on-resistance of the first gate pulse modulation switch when the first clock signal falls may be greater than the on-resistance of the first gate pulse modulation switch when the first clock signal rises.

An on-resistance of the second gate pulse modulation switch when the second clock signal rises may be greater than the on-resistance of the second gate pulse modulation switch when the second clock signal falls.

The level shifter may further include a clock control circuit configured to control the first clock output circuit and the second clock output circuit based on a generation clock signal and a modulation clock signal.

The clock control circuit may output control signals for controlling on-off of each of the first rising switch, the first falling switch, and the first gate pulse modulation switch based on a first pulse of the generation clock signal and a first pulse of the modulation clock signal.

The clock control circuit may output control signals for controlling on-off of each of the second rising switch, the second falling switch, and the second gate pulse modulation switch based on a second pulse of the generation clock signal and a second pulse of the modulation clock signal.

The first gate pulse modulation switch may include two or more first sub-switches connected in parallel between the intermediate input terminal and the first output terminal and independently controlled on-off.

An on-resistance of the first gate pulse modulation switch may be in inverse proportion to the number of turned-on first sub-switches among the two or more first sub-switches.

The second gate pulse modulation switch may include two or more second sub-switches connected in parallel between the intermediate input terminal and the second output terminal.

An on-resistance of the second gate pulse modulation switch may be in inverse proportion to the number of turned-on second sub-switches among the two or more second sub-switches.

The level shifter may further include a clock control circuit configured to control a first gate voltage and a second gate voltage. The first gate voltage is a control signal for controlling on-off of the first gate pulse modulation switch. The second gate voltage is a control signal for controlling on-off of the second gate pulse modulation switch.

An on-resistance of the first gate pulse modulation switch may be changed according to the first gate voltage, and an on-resistance of the second gate pulse modulation switch may be changed according to the second gate voltage.

According to aspects of the present disclosure, there are a display device including: a substrate; a plurality of gate lines disposed on the substrate; and a gate driving circuit disposed on or connected to the substrate and configured to output a first gate signal and a second gate signal to a first gate line and a second gate line among the plurality of gate lines based on a first clock signal and a second clock signal.

The gate driving circuit includes: a first gate output buffer circuit for outputting the first gate signal based on the first clock signal; a second gate output buffer circuit for outputting the second gate signal based on the second clock signal; and a gate output control circuit for controlling the first gate output buffer circuit and the second gate output buffer circuit.

The first gate output buffer circuit includes: a first pull-up transistor connected between a first clock input terminal to which the first clock signal is input and a first gate output terminal to which the first gate signal is output; and a first pull-down transistor connected between the first gate output terminal and a base input terminal to which a base voltage is input.

The second gate output buffer circuit includes: a second pull-up transistor connected between a second clock input terminal to which the second clock signal is input and a second gate output terminal to which the second gate signal is output; and a second pull-down transistor connected between the second gate output terminal and a base input terminal to which a base voltage is input.

A gate node of the first pull-up transistor and a gate node of the second pull-up transistor may be electrically connected. A gate node of the first pull-down transistor and a gate node of the second pull-down transistor may be electrically connected.

A falling length of the first clock signal is different from a falling length of the second clock signal, or a rising length of the second clock signal is different from a rising length of the first clock signal.

According to embodiments of the present disclosure, it is possible to provide the level shifter and the display device that can reduce a characteristic variation between gate signals and thereby improve image quality.

According to embodiments of the present disclosure, it is possible to provide the level shifter and the display device capable of variously controlling a rising characteristic and/or a falling characteristic of clock signals.

According to embodiments of the present disclosure, it is possible to provide the level shifter and the display device capable of reducing the size of an arrangement area of the gate driving circuit and reducing characteristic variation between gate signals even if the gate driving circuit is disposed on the display panel in a panel built-in type.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION

Figure 1:
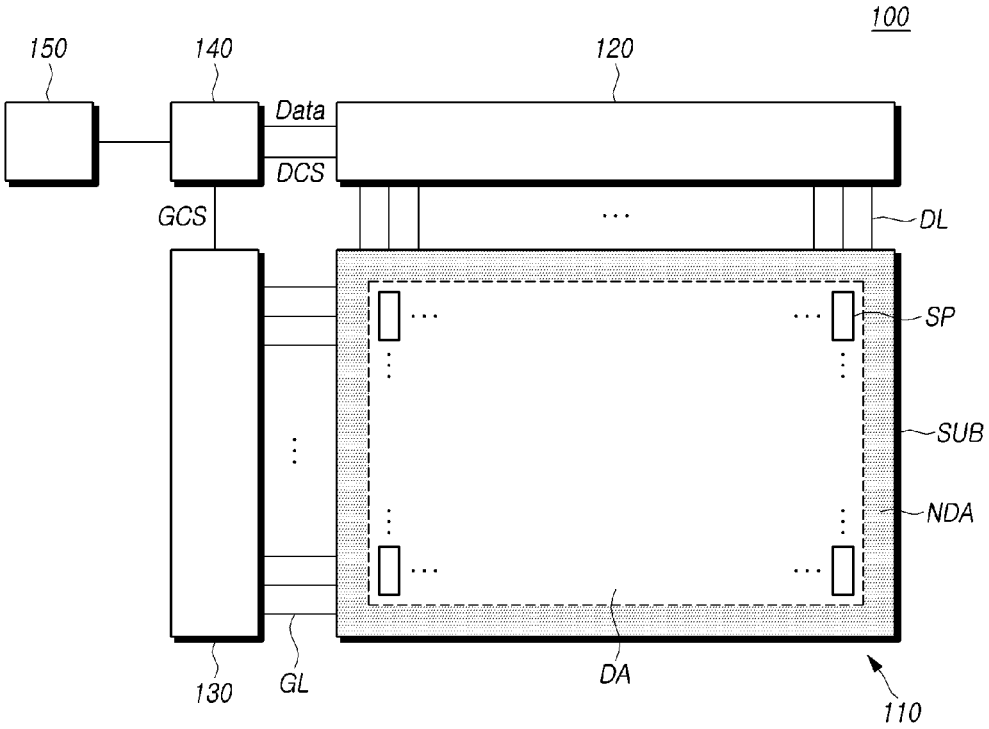
FIG. 1 is a system configuration diagram of a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 is a system configuration diagram of a display device 100 according to embodiments of the present disclosure.

Referring to FIG. 1, the display device 100 according to embodiments of the present disclosure may include a display panel 110 and a driving circuit for driving the display panel 110.

The driving circuit may include a data driving circuit 120 and a gate driving circuit 130, and may further include a controller 140 for controlling the data driving circuit 120 and the gate driving circuit 130.

The display panel 110 may include a substrate SUB and signal lines such as a plurality of data lines DL and a plurality of gate lines GL disposed on the substrate SUB. The display panel 110 may include a plurality of sub-pixels SP connected to a plurality of data lines DL and a plurality of gate lines GL.

The display panel 110 may include a display area DA in which an image is displayed and a non-display area NDA in which an image is not displayed. The plurality of sub-pixels SP for displaying an image may be disposed in the display area DA of the display panel 110. In the non-display area NDA of the display panel 110, at least one of the driving circuits 120, 130, and 140 may be electrically connected or at least one of the driving circuits 120, 130, and 140 may be mounted. A pad portion to which an integrated circuit or a printed circuit is connected may be disposed in the non-display area NDA of the display panel 110.

The data driving circuit 120 is a circuit for driving the plurality of data lines DL, and may supply data signals to the plurality of data lines DL. The gate driving circuit 130 is a circuit for driving the plurality of gate lines GL, and may supply gate signals to the plurality of gate lines GL. The controller 140 may supply a data control signal DCS to the data driving circuit 120 to control the operation timing of the data driving circuit 120. The controller 140 may supply a gate control signal GCS for controlling the operation timing of the gate driving circuit 130 to the gate driving circuit 130.

The controller 140 may start a scan according to timing implemented in each frame, and may control data drive at an appropriate time according to the scan. The controller 140 may convert input image data input from the outside according to a data signal format used by the data driving circuit 120 and supply the converted image data Data to the data driving circuit 120.

The controller 140 may receive various timing signals from the outside (e.g., host system 150) together with the input image data. For example, various timing signals may include a vertical synchronization signal (VSYNC), a horizontal synchronization signal (HSYNC), an input data enable signal DE, and a clock signal.

In order to control the data driving circuit 120 and the gate driving circuit 130, the controller 140 may receive the timing signals (e.g., VSYNC, HSYNC, DE, clock signal, etc.) to generate the various control signals (e.g., DCS, GCS, etc.), and may output the generated various control signals (e.g., DCS, GCS, etc.) to the data driving circuit 120 and the gate driving circuit 130.

For example, the controller 140 may output various gate control signals GCS including a gate start pulse (GSP), a gate shift clock (GSC), and a gate output enable signal (GOE) to control the gate driving circuit 130.

In addition, the controller 140 may output various data control signals DCS including a source start pulse (SSP), a source sampling clock (SSC), and a source output enable signal (SOE) to control the data driving circuit 120.

The controller 140 may be implemented as a separate component from the data driving circuit 120, or may be integrated with the data driving circuit 120 and implemented as an integrated circuit.

The data driving circuit 120 may drive the plurality of data lines DL by receiving image data Data from the controller 140 and supplying data voltages to the plurality of data lines DL. Here, the data driving circuit 120 is also referred to as a source driving circuit.

The data driving circuit 120 may include one or more source driver integrated circuits (SDICs).

Each source driver integrated circuit (SDIC) may include a shift register, a latch circuit, a digital to analog converter (DAC), an output buffer, and the like. Each source driver integrated circuit (SDIC) may further include an analog to digital converter (ADC) in some cases.

For example, each source driver integrated circuit (SDIC) may be connected to the display panel 110 in a TAB (tape automated bonding) type, connected to a bonding pad of the display panel 110 in a COG (chip-on-glass) type or a COP (chip-on-panel) type, or implemented in a COF (chip-on-film) type to be connected to the display panel 110.

The gate driving circuit 130 may output a gate signal of a turn-on level voltage or a gate signal of a turn-off level voltage under the control of the controller 140. The gate driving circuit 130 may sequentially drive the plurality of gate lines GL by sequentially supplying a gate signal having a turn-on level voltage to the plurality of gate lines GL.

The gate driving circuit 130 may be connected to the display panel 110 in a TAB type, connected to a bonding pad of the display panel 110 in a COG type or a COP type, or implemented as a COF type to be connected to the display panel 110. Alternatively, the gate driving circuit 130 may be formed in the non-display area NDA of the display panel 110 in a GIP (gate-in-panel) type. The gate driving circuit 130 may be disposed on or connected to the substrate SUB. As described above, in the case of the GIP type, the gate driving circuit 130 may be disposed in the non-display area NDA of the substrate SUB. The gate driving circuit 130 may be connected to the substrate SUB in the case of a COG type, a COF type, or the like.

Meanwhile, at least one of the data driving circuit 120 and the gate driving circuit 130 may be disposed in the display area DA. For example, at least one of the data driving circuit 120 and the gate driving circuit 130 may be disposed so as not to overlap the sub-pixels SP. Alternatively, at least one of the data driving circuit 120 and the gate driving circuit 130 may be disposed to partially or entirely overlap the sub-pixels SP.

When any one gate line GL is driven by the gate driving circuit 130, the data driving circuit 120 may convert the image data received from the controller 140 into an analog data voltage and supply the converted data voltage to the plurality of data lines DL.

The data driving circuit 120 may be connected to one side (e.g., an upper side or a lower side) of the display panel 110. Depending on the driving method, the panel design method, etc., the data driving circuit 120 may be connected to both sides (e.g., upper and lower sides) of the display panel 110 or to two or more of the four sides of the display panel 110.

The gate driving circuit 130 may be connected to one side (e.g., left side or right side) of the display panel 110. Depending on the driving method, the panel design method, etc., the gate driving circuit 130 may be connected to both sides (e.g., left side and right side) of the display panel 110 or to at least two of the four sides of the display panel 110.

The controller 140 may be a timing controller used in a typical display technology. Alternatively, the controller 140 may be a control device capable of further performing other control functions in addition to the functions of the timing controller. Alternatively, the controller 140 may be a control device different from the timing controller, or may be a circuit within the control device. For example, the controller 140 may be implemented with various circuits or electronic components, such as an integrated circuit (IC), a field programmable gate array (FPGA), an application specific integrated circuit (ASIC), or a processor.

The controller 140 may be mounted on a printed circuit board, a flexible printed circuit, etc., and may be electrically connected to the data driving circuit 120 and the gate driving circuit 130 through the printed circuit board, the flexible printed circuit, etc.

The controller 140 may transmit and receive signals to and from the data driving circuit 120 according to one or more predetermined interfaces. Here, for example, the interface may include a low voltage differential signaling (LVDS) interface, an EPI interface, and a serial peripheral interface (SPI).

The controller 140 may include a storage medium such as one or more registers.

The display device 100 according to embodiments of the present disclosure may be a display including a backlight unit such as a liquid crystal display, or a self-luminous display in which the display panel 110 emits light by itself. For example, the self-luminous display may be one of an organic light emitting diode (OLED) display, a quantum dot display, an inorganic-based light emitting diode display, and the like.

When the display device 100 according to embodiments of the present disclosure is an OLED display, each sub-pixel SP may include an organic light emitting diode (OLED) emitting light as a light emitting device. When the display device 100 according to the present exemplary embodiment is a quantum dot display, each sub-pixel SP may include a light emitting device made of quantum dots, which are semiconductor crystals that emit light by themselves. When the display device 100 according to the present embodiments is an LED display, each sub-pixel SP emits light by itself and may include a micro LED (micro light emitting diode) made of an inorganic material as a light emitting device.

Figure 2A:
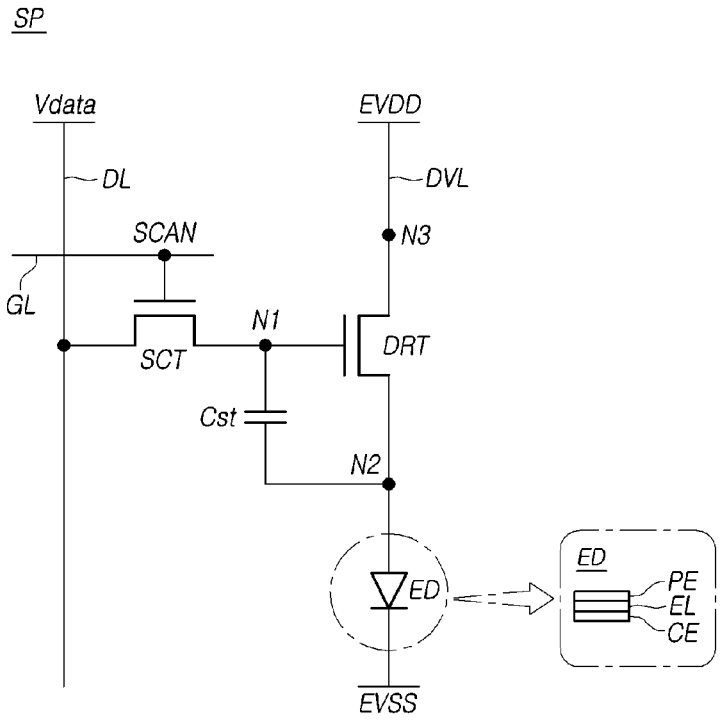
FIGS. 2A and 2B are equivalent circuits of sub-pixel of the display device according to embodiments of the present disclosure.
Figure 2B:
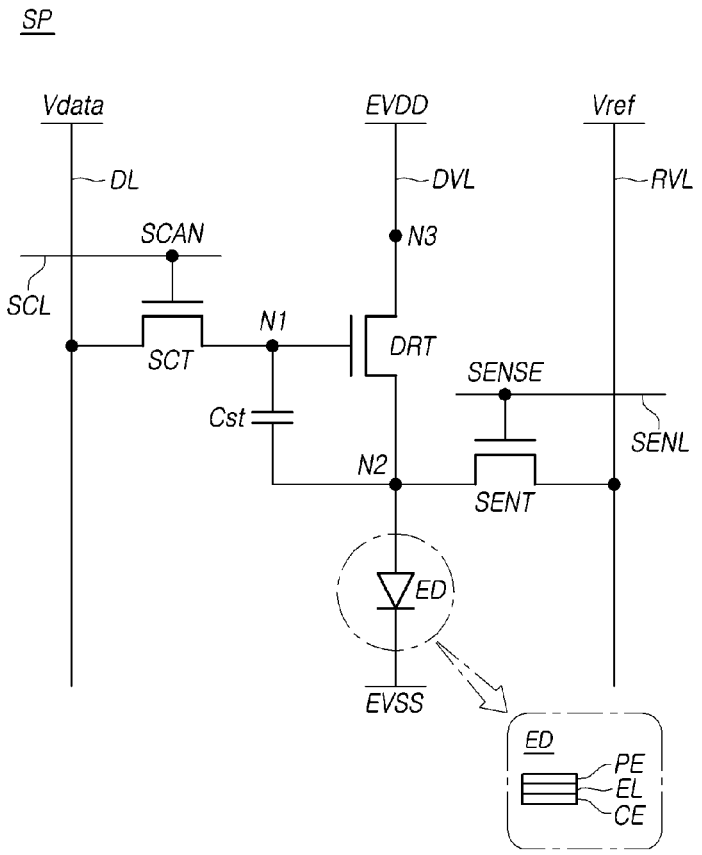

FIGS. 2A and 2B are equivalent circuits of sub-pixel SP of the display device 100 according to embodiments of the present disclosure.

Referring to FIG. 2A, each of the plurality of sub-pixels SP disposed on the display panel 110 of the display device 100 according to embodiments of the present disclosure may include a light emitting device ED, a driving transistor DRT, a scan transistor SCT, and a storage capacitor Cst.

Referring to FIG. 2A, the light emitting device ED may include a pixel electrode PE and a common electrode CE, and may include a light emitting layer EL positioned between the pixel electrode PE and the common electrode CE.

The pixel electrode PE of the light emitting device ED may be an electrode disposed in each sub-pixel SP, and the common electrode CE may be an electrode commonly disposed in all sub-pixels SP. Here, the pixel electrode PE may be an anode electrode and the common electrode CE may be a cathode electrode. Conversely, the pixel electrode PE may be a cathode electrode and the common electrode CE may be an anode electrode.

For example, the light emitting device ED may be an organic light emitting diode (OLED), a light emitting diode (LED), or a quantum dot light emitting device.

The driving transistor DRT may be a transistor for driving the light emitting device ED, and may include a first node N1, a second node N2, a third node N3, and the like.

The first node N1 of the driving transistor DRT may be a gate node of the driving transistor DRT, and may be electrically connected to a source node or a drain node of the scan transistor SCT. The second node N2 of the driving transistor DRT may be a source node or a drain node of the driving transistor DRT, and may be electrically connected to the pixel electrode PE of the light emitting device ED. The third node N3 of the driving transistor DRT may be electrically connected to the driving voltage line DVL supplying the driving voltage EVDD.

The scan transistor SCT is controlled by a scan signal SCAN, which is a type of a gate signal, and may be connected between the first node N1 of the driving transistor DRT and the data line DL. In other words, the scan transistor SCT may be turned on or off according to the scan signal SCAN supplied from the scan signal line SCL, which is one type of the gate line GL. Accordingly, the scan transistor SCT may control the connection between the data line DL and the first node N1 of the driving transistor DRT.

The scan transistor SCT may be turned on by the scan signal SCAN having a turn-on level voltage to transfer the data voltage Vdata supplied from the data line DL to the first node N1 of the driving transistor DRT.

Here, when the scan transistor SCT is an n-type transistor, the turn-on level voltage of the scan signal SCAN may be a high level voltage. When the scan transistor SCT is a p-type transistor, the turn-on level voltage of the scan signal SCAN may be a low level voltage.

The storage capacitor Cst may be connected between the first node N1 and the second node N2 of the driving transistor DRT. The storage capacitor Cst may be charged with an amount of charge corresponding to the voltage difference between the terminals, and may serve to maintain the voltage difference between the terminals for a predetermined frame time. Accordingly, during a predetermined frame time, the corresponding sub-pixel SP may emit light.

Referring to FIG. 2B, each of the plurality of sub-pixels SP disposed on the display panel 110 of the display device 100 according to embodiments of the present disclosure may further include a sensing transistor SENT.

The sensing transistor SENT may be controlled by a sense signal SENSE, which is a type of a gate signal, and may be connected between the second node N2 of the driving transistor DRT and the reference voltage line RVL. The sensing transistor SENT may be turned on or turned off according to the sense signal SENSE supplied from the sense signal line SENL, which is a type of the gate line GL, to control the connection between the reference voltage line RVL and the second node N2 of the driving transistor DRT.

The sensing transistor SENT may be turned on by the sense signal SENSE having a turn-on level voltage, and may transfer the reference voltage Vref supplied from the reference voltage line RVL to the second node N2 of the driving transistor DRT.

In addition, the sensing transistor SENT may be turned on by the sense signal SENSE having a turn-on level voltage to transfer the voltage of the second node N2 of the driving transistor DRT to the reference voltage line RVL. At this time, the reference voltage line RVL may be in a state to which the reference voltage Vref is not applied.

Here, when the sensing transistor SENT is an n-type transistor, the turn-on level voltage of the sense signal SENSE may be a high level voltage. When the sensing transistor SENT is a p-type transistor, the turn-on level voltage of the sense signal SENSE may be a low level voltage.

A function in which the sensing transistor SENT transfers the voltage of the second node N2 of the driving transistor DRT to the reference voltage line RVL may be used during driving to sense the characteristic value of the sub-pixel SP. In this case, the voltage transferred to the reference voltage line RVL may be a voltage for calculating the characteristic value of the sub-pixel SP or a voltage in which the characteristic value of the sub-pixel SP is reflected.

In the present disclosure, the characteristic value of the sub-pixel SP may be a characteristic value of the driving transistor DRT or the light emitting device ED. The characteristic value of the driving transistor DRT may include a threshold voltage and mobility of the driving transistor DRT. The characteristic value of the light emitting device ED may include a threshold voltage of the light emitting device ED.

Each of the driving transistor DRT, the scan transistor SCT, and the sensing transistor SENT may be an n-type transistor or a p-type transistor. In the present disclosure, for convenience of description, it is assumed that each of the driving transistor DRT, the scan transistor SCT, and the sensing transistor SENT is an n-type.

The storage capacitor Cst may not be a parasitic capacitor (e.g., gate-source parasitic capacitance Cgs, gate-drain parasitic capacitance Cgd) that is an internal capacitor existing between the gate node and the source node (or drain node) of the driving transistor DRT, but may be an external capacitor intentionally designed outside the driving transistor DRT.

The scan signal line SCL and the sense signal line SENL may be different gate lines GL. In this case, the scan signal SCAN and the sense signal SENSE may be separate gate signals, the on-off timing of the scan transistor SCT and the on-off timing of the sensing transistor SENT in one sub-pixel SP may be independent. That is, the on-off timing of the scan transistor SCT and the on-off timing of the sensing transistor SENT in one sub-pixel SP may be the same or different.

Alternatively, the scan signal line SCL and the sense signal line SENL may be the same gate line GL. That is, the gate node of the scan transistor SCT and the gate node of the sensing transistor SENT in one sub-pixel SP may be connected to one gate line GL. In this case, the scan signal SCAN and the sense signal SENSE may be the same gate signal, the on-off timing of the scan transistor SCT and the on-off timing of the sensing transistor SENT in one sub-pixel SP may be the same.

The structure of the sub-pixel SP shown in FIGS. 2A and 2B is merely an example, and the sub-pixel SP further includes one or more transistors or includes one or more capacitors and may be variously modified.

In addition, the sub-pixel structure illustrated in FIGS. 2A and 2B has been described on the assumption that the display device 100 is a self-luminous display device. When the display device 100 is a liquid crystal display, each sub-pixel SP may include a transistor and a pixel electrode.

Figure 3:
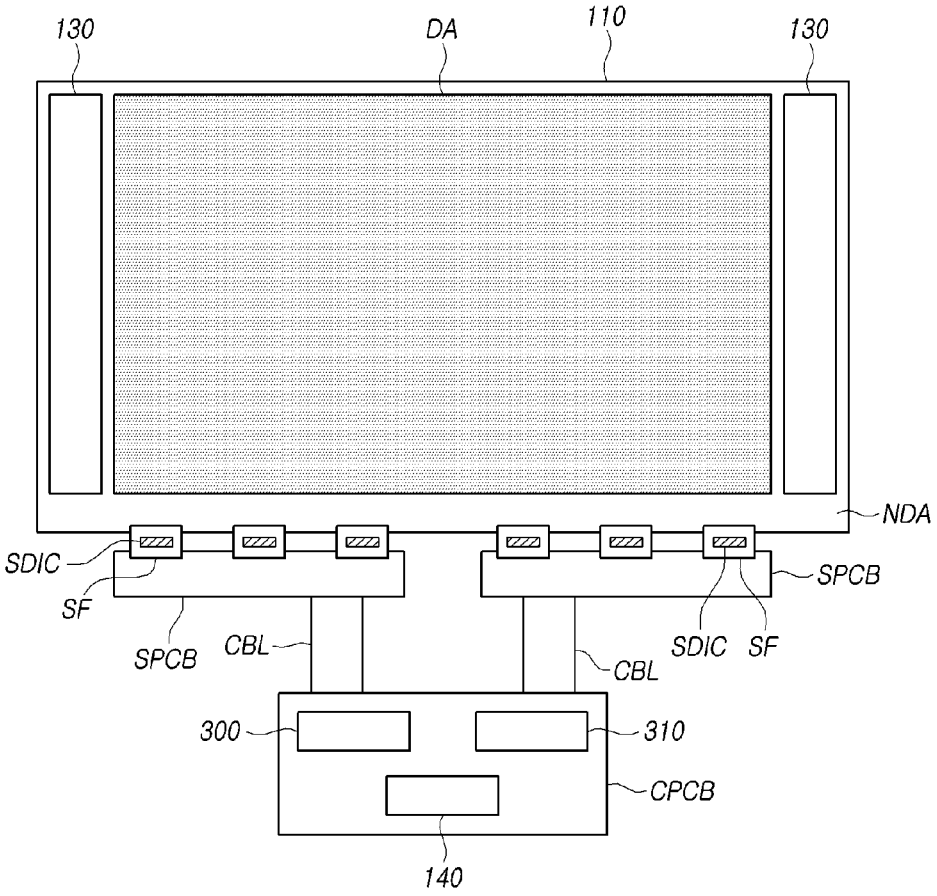
FIG. 3 is an exemplary diagram illustrating a system implementation of the display device according to embodiments of the present disclosure.

FIG. 3 is an exemplary diagram illustrating a system implementation of the display device 100 according to embodiments of the present disclosure.

Referring to FIG. 3, the display panel 110 may include the display area DA in which an image is displayed and the non-display area NDA in which an image is not displayed.

Referring to FIG. 3, when the data driving circuit 120 includes at least one source driver integrated circuit SDIC and is implemented as a COF type, each source driver integrated circuit SDIC may be mounted on the circuit film SF connected to the non-display area NDA of the display panel 110.

Referring to FIG. 3, the gate driving circuit 130 may be implemented as a GIP type. In this case, the gate driving circuit 130 may be formed in the non-display area NDA of the display panel 110. Alternatively, the gate driving circuit 130 may be implemented as a COF type.

The display device 100 may include at least one source printed circuit board SPCB for circuit connection between one or more source driver integrated circuits SDIC and other devices, and a control printed circuit board CPCB for mounting control elements (e.g., controller 140) and various electrical devices.

The circuit film SF on which the source driver integrated circuit SDIC is mounted may be connected to at least one source printed circuit board SPCB. More specifically, the source driver integrated circuit SDIC may be mounted on the circuit film SF. A portion of the circuit film SF may be electrically connected to the display panel 110, and another portion of the circuit film SF may be electrically connected to the source printed circuit board SPCB.

The controller 140 and a power management integrated circuit 310 may be mounted on the control printed circuit board CPCB. The controller 140 may perform overall control functions related to driving of the display panel 110, and may control operations of the data driving circuit 120 and the gate driving circuit 130. The power management integrated circuit 310 may supply various voltages or currents to the data driving circuit 120 and the gate driving circuit 130, or may control various voltages or currents to be supplied to the data driving circuit 120 and the gate driving circuit 130.

At least one source printed circuit board SPCB and the control printed circuit board CPCB may be connected through at least one connection cable CBL. For example, the connection cable CBL may include a flexible printed circuit (FPC), a flexible flat cable (FFC), and the like.

At least one source printed circuit board SPCB and the control printed circuit board CPCB may be implemented by being integrated into one printed circuit board.

The display device 100 according to embodiments of the present disclosure may further include a level shifter 300 for adjusting a voltage level. For example, the level shifter 300 may be disposed on the control printed circuit board CPCB or the source printed circuit board SPCB.

In particular, in the display device 100 according to embodiments of the present disclosure, the level shifter 300 may supply signals necessary for gate driving to the gate driving circuit 130. For example, the level shifter 300 may supply a plurality of clock signals to the gate driving circuit 130. Accordingly, the gate driving circuit 130 may output the plurality of gate signals to the plurality of gate lines GL based on the plurality of clock signals input from the level shifter 300. The plurality of gate lines GL may transmit the plurality of gate signals to the sub-pixels SP disposed in the display area DA of the substrate SUB.

Figure 4:
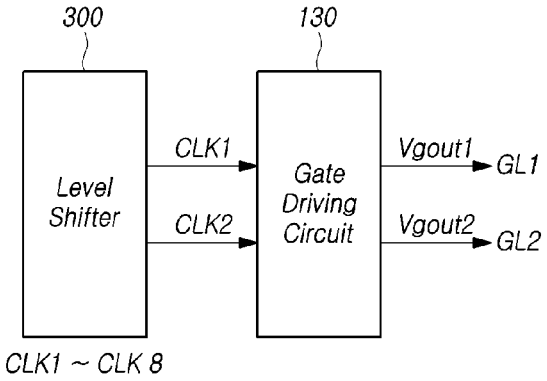
FIG. 4 illustrates a gate signal output system of the display device according to embodiments of the present disclosure.

FIG. 4 illustrates a gate signal output system of the display device 100 according to embodiments of the present disclosure.

Referring to FIG. 4, the level shifter 300 may output a first clock signal CLK1 and a second clock signal CLK2 to the gate driving circuit 130. The gate driving circuit 130 may generate and output the first gate signal Vgout1 and the second gate signal Vgout2 based on the first clock signal CLK1 and the second clock signal CLK2.

The first gate signal Vgout1 and the second gate signal Vgout2 may be respectively supplied to the first gate line GL1 and the second gate line GL2 disposed on the display panel 110. For example, each of the first gate signal Vgout1 and the second gate signal Vgout2 may be the scan signal SCAN applied to the gate node of the scan transistor SCT of FIG. 2A or 2B. As another example, each of the first gate signal Vgout1 and the second gate signal Vgout2 may be the sense signal SENSE applied to the gate node of the sensing transistor SENT of FIG. 2B.

For example, when the gate driving circuit 130 performs gate driving in 8 phases, the level shifter 300 may generate and output eight clock signals CLK1 to CLK8, and the gate driving circuit 130 may perform gate driving using eight clock signals CLK1 to CLK8.

Figure 5:
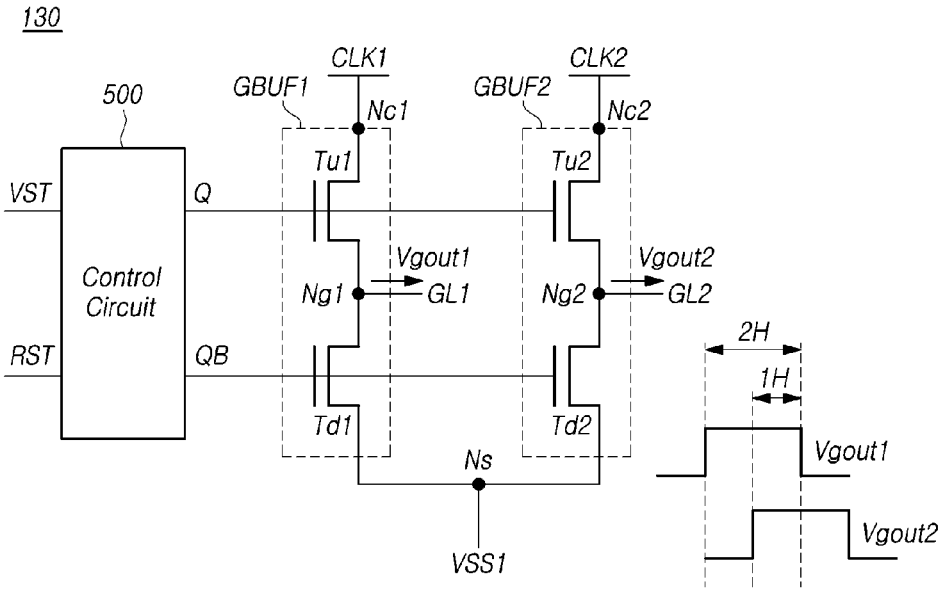
FIG. 5 is a gate driving circuit having a structure in which two gate output buffer circuits share one Q node in the display device according to embodiments of the present disclosure.

FIG. 5 is a gate driving circuit having a structure in which two gate output buffer circuits GBUF1 and GBUF2 share one Q node in the display device 100 according to embodiments of the present disclosure.

Referring to FIG. 5, the gate driving circuit 130 may receive the first clock signal CLK1 and the second clock signal CLK2, and may output the first gate signal Vgout1 and the second gate signal Vgout2 to the first gate line GL1 and the second gate line GL2 among the plurality of gate lines GL based on the first clock signal CLK1 and the second clock signal CLK2.

The first gate line GL1 and the second gate line GL2 to which the first gate signal Vgout1 and the second gate signal Vgout2 are applied may be disposed adjacent to each other.

Alternatively, the first gate line GL1 and the second gate line GL2 to which the first gate signal Vgout1 and the second gate signal Vgout2 are applied may be disposed apart from each other. In this case, another gate line GL may be disposed between the first gate line GL1 and the second gate line GL2.

The gate drive circuit 130 may include a first gate output buffer circuit GBUF1, a second gate output buffer circuit GBUF2, and a gate output control circuit 500. The first gate output buffer circuit GBUF1 may output the first gate signal Vgout1 based on the first clock signal CLK1. The second gate output buffer circuit GBUF2 may output the second gate signal Vgout2 based on the second clock signal CLK2. The gate output control circuit 500 may control the first gate output buffer circuit GBUF1 and the second gate output buffer circuit GBUF2.

The first gate output buffer circuit GBUF1 may include a first pull-up transistor Tu1 and a first pull-down transistor Td1. The first pull-up transistor Tu1 may be connected between a first clock input terminal Nc1 to which the first clock signal CLK1 is input and a first gate output terminal Ng1 to which the first gate signal Vgout1 is output. The first pull-down transistor Td1 may be connected between the first gate output terminal Ng1 and the base input terminal Ns to which a base voltage VSS1 is input.

The second gate output buffer circuit GBUF2 may include a second pull-up transistor Tu2 and a second pull-down transistor Td2. The second pull-up transistor Tu2 may be connected between a second clock input terminal Nc2 to which the second clock signal CLK2 is input and a second gate output terminal Ng2 to which the second gate signal Vgout2 is output. The second pull-down transistor Td2 may be connected between the second gate output terminal Ng2 and the base input terminal Ns.

The gate output control circuit 500 may receive the start signal VST, the reset signal RST, and the like, and control the operations of the first gate output buffer circuit GBUF1 and the second gate output buffer circuit GBUF2. To this end, the gate output control circuit 500 may control the voltage of the Q node and the voltage of the QB node.

Referring to FIG. 5, the gate node of the first pull-up transistor Tu1 and the gate node of the second pull-up transistor Tu2 may be electrically connected. That is, the gate node of the first pull-up transistor Tu1 and the gate node of the second pull-up transistor Tu2 may be commonly connected to the Q node.

Therefore, by the voltage of the Q node controlled by the gate output control circuit 500, the first pull-up transistor Tu1 of the first gate output buffer circuit GBUF1 and the second pull-up transistor Tu2 of the second gate output buffer circuit GBUF2 may be simultaneously turned on or turned off simultaneously.

The gate node of the first pull-down transistor Td1 and the gate node of the second pull-down transistor Td2 may be electrically connected. That is, the gate node of the first pull-down transistor Td1 and the gate node of the second pull-down transistor Td2 may be commonly connected to the QB node.

Therefore, by the voltage of the QB node controlled by the gate output control circuit 500, the first pull-down transistor Td1 of the first gate output buffer circuit GBUF1 and the second pull-down transistor Td2 of the second gate output buffer circuit GBUF2 are simultaneously turned on or turned off simultaneously.

For example, when the gate driving circuit 130 performs gate driving in 8 phases, the level shifter 300 may generate and output eight clock signals CLK1, CLK2, CLK3, CLK4, CLK5, CLK6, CLK7, and CLK8. The gate driving circuit 130 may perform gate driving using eight clock signals CLK1, CLK2, CLK3, CLK4, CLK5, CLK6, CLK7, and CLK8.

As in the previous example, when the gate driving circuit 130 performs gate driving in 8 phases and has a structure in which two gate output buffer circuits GBUF1 and GBUF2 share one Q node, as shown in FIG. 5, the odd-numbered clock signals CLK1, CLK3, CLK5, and CLK7 among the eight clock signals CLK1 to CLK8 may have the same signal characteristics, and may be respectively input to the first gate output buffer circuits GBUF1 connected to different Q nodes to be used to generate gate signals. The even-numbered clock signals CLK2, CLK4, CLK6, and CLK8 among the eight clock signals CLK1 to CLK8 may have the same signal characteristics, and may be respectively input to the second gate output buffer circuits GBUF2 connected to different Q nodes Q to be used to generate gate signals.

Therefore, below, a representative clock signal of the odd-numbered clock signals CLK1, CLK3, CLK5, and CLK7 having the same signal characteristics will be described as a first clock signal CLK1. And a representative clock signal of the even-numbered clock signals CLK2, CLK4, CLK6, and CLK8 having the same signal characteristics is referred to as a second clock signal CLK2.

Meanwhile, in the display device 100 according to embodiments of the present disclosure, the gate driving circuit 130 may perform overlap gate driving.

When the gate driving circuit 130 performs overlap gate driving, a high level voltage section of each of the first and second clock signals CLK1 and CLK2 may partially overlap. Accordingly, turn-on level voltage sections of the first gate signal Vgout1 and the second gate signal Vgout2 corresponding to successive driving timings may partially overlap. Here, the turn-on level voltage section of each of the first gate signal Vgout1 and the second gate signal Vgout2 may be a high level voltage section or a low level voltage section. Hereinafter, for convenience of description, the turn-on level voltage section of each of the first gate signal Vgout1 and the second gate signal Vgout2 will be described as the high level voltage section.

When the gate driving circuit 130 performs the overlap gate driving, the high level voltage section of the first gate signal Vgout1 and the high level voltage section of the second gate signal Vgout2 may partially overlap.

For example, each of the high level voltage section of the first gate signal Vgout1 and the high level voltage section of the second gate signal Vgout2 may have a temporal length of 2H. In this case, an overlapping section in which the high level voltage section of the first gate signal Vgout1 and the high level voltage section of the second gate signal Vgout2 overlap may have a temporal length of 1H.

When the gate driving circuit 130 is of the GIP type and has a Q node sharing structure, the size of the bezel area (non-display area NDA) of the display panel 110 may be reduced. In addition, when the gate driving circuit 130 performs the overlap gate driving, the charging time of the storage capacitor Cst disposed in each of the plurality of sub-pixels SP may be increased to improve image quality.

Figure 6:
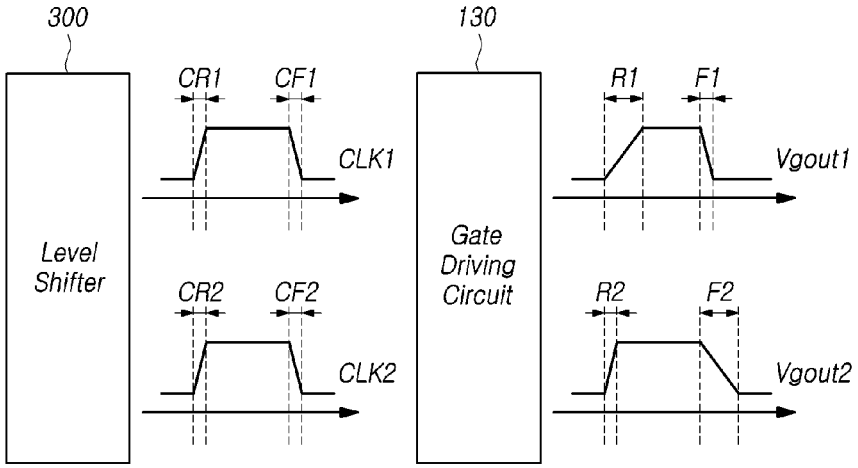
FIG. 6 is a diagram illustrating a characteristic deviation between gate signals output from the gate driving circuit of FIG. 5 according to embodiments of the present disclosure.

FIG. 6 is a diagram illustrating a characteristic deviation between gate signals Vgout1 and Vgout2 output from the gate driving circuit 130 of FIG. 5 according to one embodiment.

Referring to FIG. 6, the level shifter 300 may output the first clock signal CLK1 and the second clock signal CLK2. Here, the first clock signal CLK1 and the second clock signal CLK2 may have the same signal waveform and signal characteristics. That is, a rising length CR1 of the first clock signal CLK1 and a rising length CR2 of the second clock signal CLK2 may be equal, and a falling length CF1 of the first clock signal CLK1 and a falling length CF2 of the second clock signal CLK2 may be equal.

When the gate driving circuit 130 uses the first clock signal CLK1 and the second clock signal CLK2 having the same signal waveform and signal characteristics, has a Q node sharing structure, and performs overlap gate driving, a signal waveform of the first gate signal Vgout1 output from the gate driving circuit 130 may be different from a signal waveform of the second gate signal Vgout2.

For example, a falling length F1 of the first gate signal Vgout1 and a falling length F2 of the second gate signal Vgout2 may be different from each other. The falling length described herein may be referred to as a falling time.

For another example, a rising length R1 of the first gate signal Vgout1 and a rising length R2 of the second gate signal Vgout2 may be different from each other. The rising length described herein may be referred to as a rising time.

The above-described deviation in output characteristics (rising characteristic deviation, falling characteristic deviation) between the first gate signal Vgout1 and the second gate signal Vgout2 may cause an operation difference between transistors (e.g., SCT and SENT in FIG. 2B) to which the first gate signal Vgout1 and the second gate signal Vgout2 are applied. Accordingly, image quality deterioration may be caused.

The display device 100 according to the embodiments of the present disclosure may obtain an effect of improving image quality by increasing the charging time in each sub-pixel SP by performing overlap gate driving, and may obtain an effect of reducing the size of the bezel area (non-display area NDA) of the display panel 110 through the Q node sharing structure. The display device 100 according to the exemplary embodiments of the present disclosure may provide a compensation method capable of reducing output characteristic deviation between gate signals Vgout1 and Vgout2 that may be caused through simultaneous application of the overlap gate driving and the Q node sharing structure. Hereinafter, this will be described in detail.

Figure 7A:
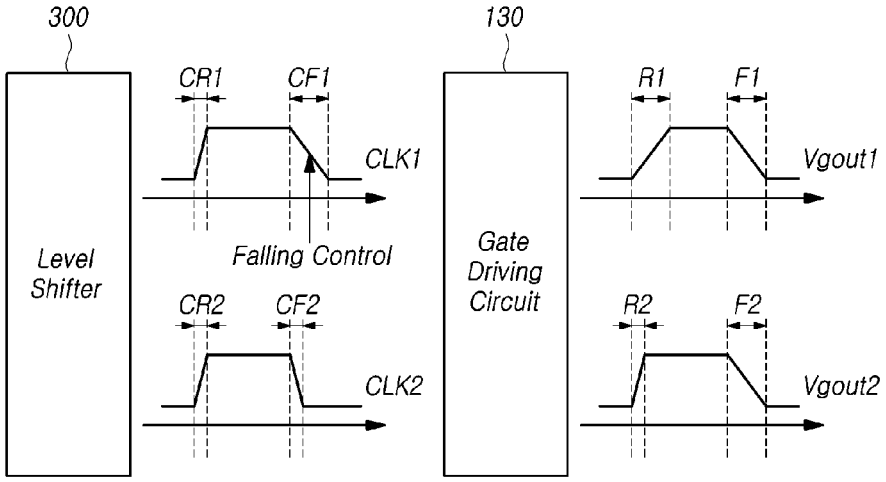
FIGS. 7A, 7B, and 7C are diagrams for explaining a characteristic deviation compensation function between gate signals output from the gate driving circuit of FIG. 5 according to embodiments of the present disclosure.
Figure 7B:
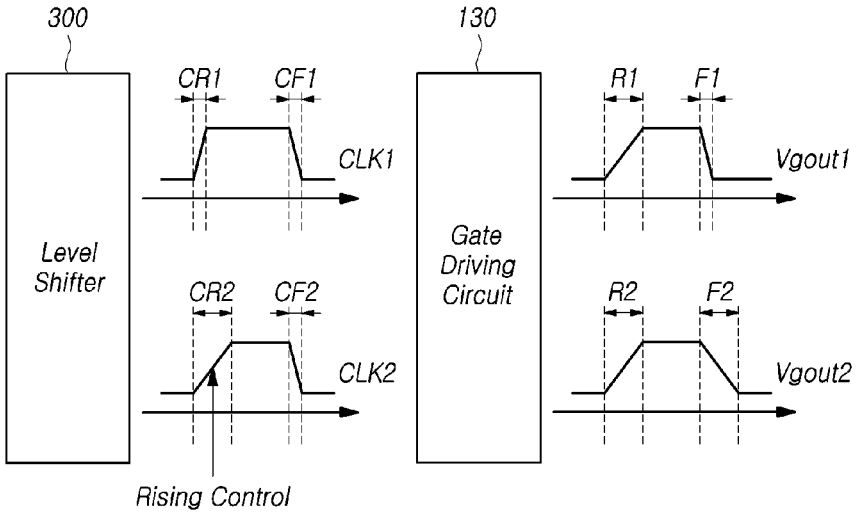
Figure 7C:
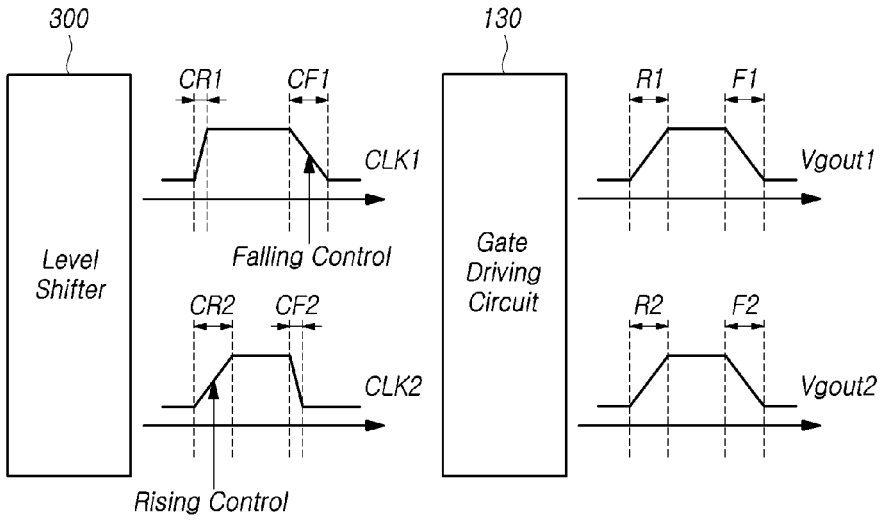

FIGS. 7A, 7B, and 7C are diagrams for explaining a characteristic deviation compensation function between gate signals Vgout1 and Vgout2 output from the gate driving circuit 130 of FIG. 5 according to one embodiment.

Referring to FIGS. 7A to 7C, in order to compensate for the characteristic deviation between the gate signals, the level shifter 300 may generate the first clock signal CLK1 and the second clock signal CLK2 by controlling at least one of a rising characteristic and a falling characteristic of at least one of the first clock signal CLK1 and the second clock signal CLK2, and may output the generated first clock signal CLK1 and the second clock signal CLK2.

Accordingly, the falling length CF1 of the first clock signal CLK1 and the falling length CF2 of the second clock signal CLK2 may be different from each other, or the rising length CR1 of the first clock signal CLK1 and the rising length CR2 of the second clock signal CLK2 may be different from each other.

Referring to FIG. 7A, the level shifter 300 may control the first falling length CF1 of the first clock signal CLK1 to be longer than the second falling length CF2 of the second clock signal CLK2 through the falling control.

It will be described in more detail below. In FIG. 7A, the rising timings of the first gate signal Vgout1 and the second gate signal Vgout2 are the same, but this is only shown for convenience of description. In reality, the first gate signal Vgout1 may be a gate signal that rises first from a low level voltage to a high level voltage than the second gate signal Vgout2, and falls first from a high level voltage to a low level voltage than the second gate signal Vgout2. As such, when the first gate signal Vgout1 may be a gate signal applied to the gate line GL1 scanned before the second gate signal Vgout2, under the Q node sharing structure, a phenomenon (falling characteristic deviation in FIG. 6) in which the falling length F2 of the second gate signal Vgout2 may be relatively longer than the falling length F1 of the first gate signal Vgout1 may occur. In order to solve the falling characteristic deviation, the level shifter 300 intentionally lengthens the falling length CF1 of the first clock signal CLK1, which is the basis for generating the first gate signal Vgout1, so that the falling length F1 of the first gate signal Vgout1 may be intentionally lengthened. According to this falling control, the lengthened falling length F1 of the first gate signal Vgout1 may be equal to the originally long falling length F2 of the second gate signal Vgout2.

When the falling control is performed through the clock control of the level shifter 300, the difference between the falling length F1 of the first gate signal Vgout1 and the falling length F2 of the second gate signal Vgout2 may become smaller than the difference when the falling control is not performed.

By the falling control through the clock control of the level shifter 300, the difference between the falling length F1 of the first gate signal Vgout1 and the falling length F2 of the second gate signal Vgout2 may become smaller than the difference between the falling length CF1 of the first clock signal CLK1 and the falling length CF2 of the second clock signal CLK2.

According to the above-described falling control, the deviation in the falling characteristics between the first and second gate signals Vgout1 and Vgout2 is compensated, so that image quality can be improved.

Referring to FIG. 7B, the level shifter 300 may control the second rising time CR2 of the second clock signal CLK2 to be longer than the first rising time CR1 of the first clock signal CLK1 through the rising control.

It will be described in more detail below. In FIG. 7B, the first gate signal Vgout1 may be a gate signal that rises first from a low level voltage to a high level voltage than the second gate signal Vgout2, and falls first from a high level voltage to a low level voltage than the second gate signal Vgout2. As such, when the first gate signal Vgout1 may be a gate signal applied to the gate line GL1 scanned before the second gate signal Vgout2, under the Q node sharing structure, a phenomenon (rising characteristic deviation in FIG. 6) in which the rising length R1 of the first gate signal Vgout1 may be relatively longer than the rising length R2 of the second gate signal Vgout2 may occur. In order to solve such a rising characteristic deviation, the level shifter 300 intentionally lengthens the rising length CR2 of the second clock signal CLK2, which is the basis for generating the second gate signal Vgout2, so that the rising length R2 of the second gate signal Vgout2 may be intentionally lengthened. According to this rising control, the lengthened rising length R2 of the second gate signal Vgout2 may be equal to the originally long rising length R1 of the first gate signal Vgout1.

When the rising control is performed through the clock control of the level shifter 300, the difference between the rising length R1 of the first gate signal Vgout1 and the rising length R2 of the second gate signal Vgout2 may become smaller than the difference when the rising control is not performed.

By the rising control through the clock control of the level shifter 300 described above, the difference between the rising length R1 of the first gate signal Vgout1 and the rising length R2 of the second gate signal Vgout2 may become smaller than the difference between the rising length CR2 of the second clock signal CLK2 and the rising length CR1 of the first clock signal CLK1.

According to the above-described rising control through the clock control of the level shifter 300, the deviation in the rising characteristics between the first and second gate signals Vgout1 and Vgout2 may be compensated, and image quality may be improved.

Referring to FIG. 7C, the level shifter 300 may control the first falling length CF1 of the first clock signal CLK1 to be longer than the second falling length CF2 of the second clock signal CLK2 through the falling control. In addition, the level shifter 300 may control the second rising time CR2 of the second clock signal CLK2 to be longer than the first rising time CR1 of the first clock signal CLK1 through the rising control.

As the falling control and the rising control are performed through the clock control by the level shifter 300, the falling length CF1 of the first clock signal CLK1 may be longer than the falling length CF2 of the second clock signal CLK2, and the rising length CR2 of the second clock signal CLK2 may be longer than the rising length CR1 of the first clock signal CLK1.

As the falling control and the rising control are performed through the clock control by the level shifter 300, the difference between the falling length F1 of the first gate signal Vgout1 and the falling length F2 of the second gate signal Vgout2 may be smaller than the difference when the falling control is not performed. Furthermore, the difference between the rising length R1 of the first gate signal Vgout1 and the rising length R2 of the second gate signal Vgout2 may be smaller than a difference when the rising control is not performed.

As the falling control and the rising control are performed through the clock control by the level shifter 300, the difference between the falling length F1 of the first gate signal Vgout1 and the falling length F2 of the second gate signal Vgout2 may be smaller than the difference between the falling length CF1 of the first clock signal CLK1 and the falling length CF2 of the second clock signal CLK2. Furthermore, the difference between the rising length R1 of the first gate signal Vgout1 and the rising length R2 of the second gate signal Vgout2 may be smaller than the difference between the rising length CR2 of the second clock signal CLK2 and the rising length CR1 of the first clock signal CLK1.

As the falling control and the rising control are performed through the clock control by the level shifter 300, both the rising characteristic deviation and the falling characteristic deviation between the first and second gate signals Vgout1 and Vgout2 are compensated, so that image quality can be greatly improved.

Hereinafter, the level shifter 300 for compensating for a deviation in output characteristics between the first and second gate signals Vgout1 and Vgout2 will be described in more detail.

Figure 8:
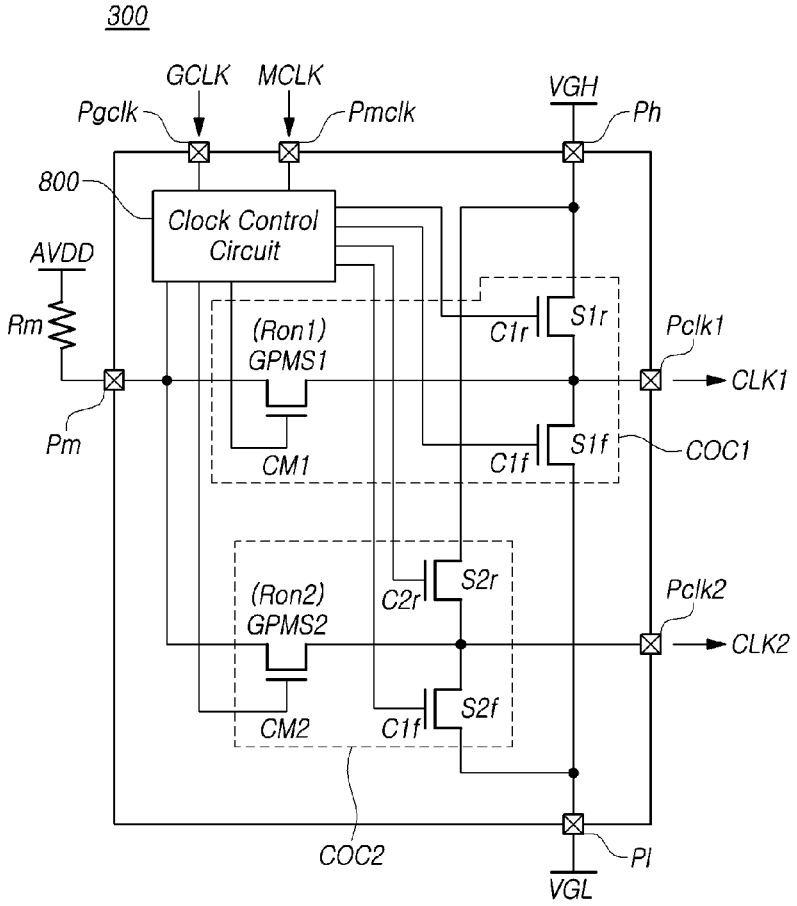
FIG. 8 is a level shifter according to embodiments of the present disclosure.
Figure 9:
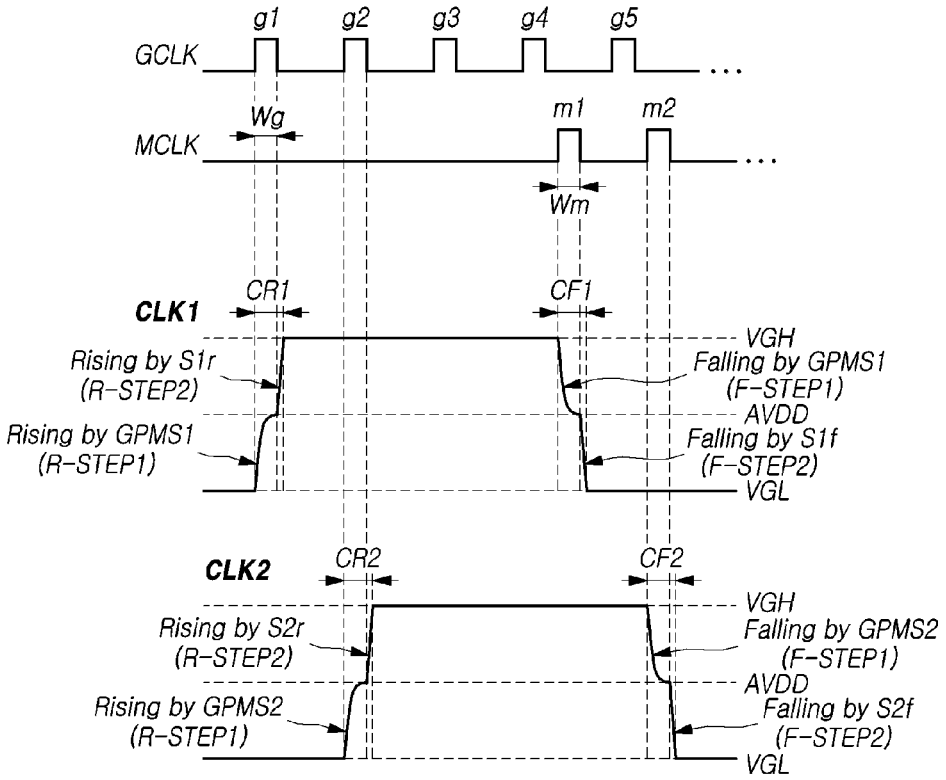
FIG. 9 is a driving timing diagram for the level shifter according to embodiments of the present disclosure.

FIG. 8 is a level shifter 300 according to embodiments of the present disclosure. FIG. 9 is a driving timing diagram for the level shifter 300 according to embodiments of the present disclosure.

Referring to FIG. 8, the level shifter 300 according to embodiments of the present disclosure may include: input terminals Ph, Pl, Pm, Pgclk, and Pmclk; output terminals Pclk1 and Pclk2; a first clock output circuit COC1 for outputting the first clock signal CLK1; a second clock output circuit COC2 for outputting the second clock signal CLK2; and a clock control circuit 800 for controlling the first clock output circuit COC1 and the second clock output circuit COC2.

Referring to FIG. 8, the input terminals Ph, Pl, Pm, Pgclk, and Pmclk may include a high input terminal Ph to which high level voltage VGH is input, a low input terminal Pl to which a low level voltage VGL is input, and an intermediate input terminal Pm to which the intermediate level voltage AVDD is input.

The high input terminal Ph, the low input terminal Pl, and the intermediate input terminal Pm may be electrically connected to the power management integrated circuit 310 that supplies the intermediate level voltage AVDD. A resistor Rm may be connected between the intermediate input terminal Pm and the power management integrated circuit 310.

Referring to FIG. 9, among the high level voltage VGH, the low level voltage VGL, and the intermediate level voltage AVDD, the high level voltage VGH may be the highest voltage (e.g., largest voltage) and the low level voltage VGL may be the lowest voltage (e.g., smallest voltage). Among the high level voltage VGH, the low level voltage VGL, and the intermediate level voltage AVDD, the intermediate level voltage AVDD may be greater than the low level voltage VGL and less than the high level voltage VGH. The intermediate level voltage AVDD may be a center voltage at the center of the high level voltage VGH and the low level voltage VGL, or a voltage higher or lower than the center voltage.

Referring to FIG. 9, the high level voltage VGH input to the high input terminal Ph may be a high level voltage of each of the first clock signal CLK1 and the second clock signal CLK2. The low level voltage VGL input to the low input terminal Pl may be a low level voltage of each of the first clock signal CLK1 and the second clock signal CLK2.

Referring to FIG. 9, while the first clock signal CLK1 rises, the voltage of the first clock signal CLK1 may be changed from the low level voltage VGL to the high level voltage VGH through the middle level voltage AVDD. While the second clock signal CLK2 rises, the voltage of the second clock signal CLK2 may be changed from the low level voltage VGL to the high level voltage VGH through the middle level voltage AVDD.

Referring to FIG. 9, while the first clock signal CLK1 falls, the voltage of the first clock signal CLK1 may be changed from the high level voltage VGH to the low level voltage VGL through the middle level voltage AVDD. While the second clock signal CLK2 falls, the voltage of the second clock signal CLK2 may be changed from the high level voltage VGH to the low level voltage VGL through the middle level voltage AVDD.

Referring to FIG. 8, the input terminals Ph, Pl, Pm, Pgclk, and Pmclk may further include a generation clock terminal Pgclk to which a generation clock signal GCLK is input and a modulation clock terminal Pmclk to which a modulation clock signal MCLK is input.

The generation clock terminal Pgclk and the modulation clock terminal Pmclk may be electrically connected to the controller 140. That is, the level shifter 300 may receive the generation clock signal GCLK and the modulation clock signal MCLK from the controller 140.

Referring to FIG. 8, the output terminals Pclk1 and Pclk2 may include a first output terminal Pclk1 outputting the first clock signal CLK1 and a second output terminal Pclk2 outputting the second clock signal CLK2. Here, the first output terminal Pclk1 and the second output terminal Pclk2 may be electrically connected to the gate driving circuit 130.

Referring to FIG. 8, the first clock output circuit COC1 may include a first rising switch S1*r* for controlling the electrical connection between the high input terminal Ph and the first output terminal Pclk1, a first falling switch S1*f* for controlling the electrical connection between the low input terminal Pl and the first output terminal Pclk1, and a first gate pulse modulation switch GPMS1 for controlling an electrical connection between the intermediate input terminal Pm and the first output terminal Pclk1.

Referring to FIG. 8, the second clock output circuit COC2 may include a second rising switch S2*r* for controlling the electrical connection between the high input terminal Ph and the second output terminal Pclk2, a second falling switch S2*f* for controlling the electrical connection between the low input terminal Pl and the second output terminal Pclk2, and a second gate pulse modulation switch GPMS2 for controlling an electrical connection between the intermediate input terminal Pm and the second output terminal Pclk2.

Each of the first rising switch S1*r*, the first falling switch S1*f*, the first gate pulse modulation switch GPMS1, the second rising switch S2*r*, the second falling switch S2*f*, and the second gate pulse modulation switch GPMS2 may be implemented as an n-type transistor or a p-type transistor.

Referring to FIG. 8, the clock control circuit 800 may control the switching operation (on-off operation) of each of the first rising switch S1*r*, the first falling switch S1*f*, the first gate pulse modulation switch GPMS1, the second rising switch S2*r*, the second falling switch S2*f*, and the second gate pulse modulation switch GPMS2.

To this end, the clock control circuit 800 may output a first rising control signal C1*r* for controlling the switching operation of the first rising switch S1*r*, a first falling control signal C1*f* for controlling the switching operation of the first falling switch S1*f*, and a first intermediate control signal CM1 for controlling a switching operation of the first gate pulse modulation switch GPMS1. And the clock control circuit 800 may output a second rising control signal C2*r* for controlling the switching operation of the second rising switch S2*r*, a second falling control signal C2*f* for controlling the switching operation of the second falling switch S2*f*, and a second intermediate control signal CM2 for controlling a switching operation of the second gate pulse modulation switch GPMS2.

Meanwhile, each of the first gate pulse modulation switch GPMS1, the first rising switch S1*r*, the first falling switch S1*f*, the second gate pulse modulation switch GPMS2, the second rising switch S2*r* and the second falling switch S2*f* may have an on-resistance. Here, the on-resistance of the switch is a resistance that prevents the flow of current flowing through the switch when a control signal (gate voltage) capable of turning on the switch is applied to the switch.

The on-resistance Ron1 of the first gate pulse modulation switch GPMS1 may be greater than the on-resistance of each of the first rising switch S1*r* and the first falling switch S1*f*. Accordingly, the switching speed of the first gate pulse modulation switch GPMS1 may be slower than the switching speed of each of the first rising switch S1*r* and the first falling switch S1*f*.

The on-resistance Ron2 of the second gate pulse modulation switch GPMS2 may be greater than the on-resistance of each of the second rising switch S2*r* and the second falling switch S2*f*. Accordingly, the switching speed of the second gate pulse modulation switch GPMS2 may be slower than the switching speed of each of the second rising switch S2*r* and the second falling switch 52*f*.

In the level shifter 300 according to embodiments of the present disclosure, each of the on-resistance Ron1 of the first gate pulse modulation switch GPMS1 and the on-resistance Ron2 of the first gate pulse modulation switch GPMS2 may be independently adjusted.

In addition, in the level shifter 300 according to embodiments of the present disclosure, each of the on-resistance of the first falling switch S1*f* and the on-resistance of the second rising switch S2*r* may be independently adjusted.

In addition, in the level shifter 300 according to embodiments of the present disclosure, each of the on-resistance of the first rising switch S1*r* and the on-resistance of the second falling switch S2*f* may be independently adjusted.

The level shifter 300 according to embodiments of the present disclosure may further include the first gate pulse modulation switch GPMS1 associated with the generation of the first clock signal CLK1, and the second gate pulse modulation switch GPMS2 associated with the generation of the second clock signal CLK2. In this respect, the level shifter 300 according to embodiments of the present disclosure has a unique feature.

Referring to FIGS. 8 and 9, the generation clock signal GCLK may include multiple pulses g1, g2, g3, g4, g5, etc., and the modulation clock signal MCLK may include a plurality of pulses m1, m2, etc.

Referring to FIGS. 8 and 9, the clock control circuit 800 may control operation timings of the first clock output circuit COC1 and the second clock output circuit COC2 based on the generation clock signal GCLK and the modulation clock signal MCLK. Accordingly, the clock control circuit 800 may control the generation and output of the first clock signal CLK1 and the second clock signal CLK2 having a desired signal waveform. Accordingly, the first clock output circuit COC1 and the second clock output circuit COC2 may output the first clock signal CLK1 and the second clock signal CLK2 having a desired signal waveform.

Referring to FIGS. 8 and 9, the clock control circuit 800 may output the first rising control signal C1*r*, the first falling control signal C1*f*, and the first intermediate control signal CM1 to the first clock output circuit COC1, based on a first pulse g1 of the generation clock signal GCLK and a first pulse m1 of the modulation clock signal MCLK. The first rising control signal C1*r* is a control signal for controlling on-off of the first rising switch S1*r* included in the first clock output circuit COC1. The first falling control signal C1*f* is a control signal for controlling on-off of the first falling switch S1*f* included in the first clock output circuit COC1. The first intermediate control signal CM1 is a control signal for controlling on-off of the first gate pulse modulation switch GPMS1 included in the first clock output circuit COC1. Accordingly, the first clock output circuit COC1 may generate and output the first clock signal CLK1 having a desired signal waveform.

Referring to FIGS. 8 and 9, the clock control circuit 800 may output the second rising control signal C2*r*, the second falling control signal C2*f*, and the second intermediate control signal CM2 to the second clock output circuit COC2, based on a second pulse g2 of the generation clock signal GCLK and a second pulse m2 of the modulation clock signal MCLK. The second rising control signal C2*r* is a control signal for controlling on-off of the second rising switch S2*r* included in the second clock output circuit COC2. The second falling control signal C2*f* is a control signal for controlling on-off of the second falling switch S2*f* included in the second clock output circuit COC2. The second intermediate control signal CM2 is a control signal for controlling on-off of the second gate pulse modulation switch GPMS2 included in the second clock output circuit COC2. Accordingly, the second clock output circuit COC2 may generate and output the second clock signal CLK2 having a desired signal waveform.

Hereinafter, a process of generating the first clock signal CLK1 and the second clock signal CLK2 will be described with reference to FIGS. 8 and 9. However, FIG. 9 shows the first clock signal CLK1 and the second clock signal CLK2 generated without a control process (falling control, rising control). In order to describe the generation of the first clock signal CLK1 and the second clock signal CLK2 when there is no control process, it is assumed that the on-resistance Ron1 of the first gate pulse modulation switch GPMS1 and the on-resistance Ron2 of the second gate pulse modulation switch GPMS2 are equal to each other and are constant without changing with time.

First, the generation of the first clock signal CLK1 will be described.

Rising of the first clock signal CLK1 may proceed in two steps. The two steps may include a first rising step R-STEP1 and a second rising step R-STPE2.

The first rising step R-STEP1 may be a step in which the voltage of the first clock signal CLK1 is changed from the low level voltage VGL to the intermediate level voltage AVDD by the first gate pulse modulation switch GPMS1.

The first rising step R-STEP1 may be started when the rising time of the first pulse g1 of the generation clock signal GCLK starts, and may proceed during the pulse period Wg of the first pulse g1 of the generation clock signal GCLK.

When the rising time of the first pulse g1 of the generation clock signal GCLK comes, the first gate pulse modulation switch GPMS1 may be turned on. During the pulse period corresponding to the pulse width Wg of the generation clock signal GCLK, the intermediate level voltage AVDD may be applied to the first output terminal Pclk1 through the turned-on first gate pulse modulation switch GPMS1. Before the intermediate level voltage AVDD is applied, the first output terminal Pclk1 may be in a state in which the low level voltage VGL is applied.

Since the on-resistance Ron1 of the first gate pulse modulation switch GPMS1 is large, the voltage of the first output terminal Pclk1 may not rapidly rise from the low level voltage VGL to the intermediate level voltage AVDD. The time it takes for the voltage of the first output terminal Pclk1 to rise to the intermediate level voltage AVDD may be a period corresponding to the pulse width Wg of the generation clock signal GCLK.

The second rising step R-STEP2 may be performed following the first rising step R-STEP1. The second rising step R-STEP2 may be a step in which the voltage of the first clock signal CLK1 is changed from the intermediate level voltage AVDD to the high level voltage VGH by the first rising switch S1*r*.

The second rising step R-STEP2 may be started when the falling time of the first pulse g1 of the generation clock signal GCLK starts.

The first rising switch S1*r* may be turned on when the falling time of the first pulse g1 of the generation clock signal GCLK starts. Accordingly, the high level voltage VGH may be applied to the first output terminal Pclk1 through the turned-on first rising switch S1*r*. Before the high level voltage VGH is applied, the first output terminal Pclk1 may be in a state in which the intermediate level voltage AVDD is applied.

The on-resistance of the first rising switch S1*r* may be smaller than the on-resistance Ron1 of the first gate pulse modulation switch GPMS1. Accordingly, when the first rising switch S1*r* is turned on, the voltage of the first output terminal Pclk1 may rapidly increase from the intermediate level voltage AVDD to the high level voltage VGH. A voltage rising slope (voltage rising rate) of the first output terminal Pclk1 in the second rising step R-STEP2 may be steeper (greater) than a voltage rising slope (voltage rising rate) of the first output terminal Pclk1 in the first rising step R-STEP1.

After the first output terminal Pclk1 is changed to the high level voltage VGH, the first rising switch S1*r* may maintain the turn-on state until the falling start time of the first clock signal CLK1 is reached. Accordingly, the first output terminal Pclk1 may maintain the high level voltage VGH until the falling start time of the first clock signal CLK1 occurs.

After the first clock signal CLK1 rises by the first pulse g1 of the generation clock signal GCLK, when the rising time of the first pulse m1 of the modulation clock signal MCLK comes, the falling of the first clock signal CLK1 may start. Here, the first pulse g1 among the plurality of pulses g1, g2, and etc. included in the generation clock signal GCLK may be a pulse triggering the rising of the first clock signal CLK1. The first pulse m1 among the plurality of pulses m1, m2, and etc. included in the modulation clock signal MCLK may be a pulse triggering the falling of the first clock signal CLK1. In this sense, the first pulse g1 of the generation clock signal GCLK and the first pulse m1 of the modulation clock signal MCLK may be related to each other and involved in the generation (rising, falling) of the same first clock signal CLK1.

The rising length CR1 of the first clock signal CLK1 may be the sum of the temporal length Wg of the first rising step R-STEP1 and the temporal length of the second rising step R-STEP2.

The falling of the first clock signal CLK1 may also proceed in two steps. The two steps may include a first falling step F-STEP1 and a second falling step F-STEP2.

The first falling step F-STEP1 may be a step in which the voltage of the first clock signal CLK1 is changed from the high level voltage VGH to the intermediate level voltage AVDD by the first gate pulse modulation switch GPMS1.

The first falling step F-STEP1 may start at the rising time of the first pulse m1 of the modulation clock signal MCLK, and may proceed during the pulse period Wm of the first pulse m1 of the modulation clock signal MCLK.

When the rising time of the first pulse m1 of the modulation clock signal MCLK comes, the first gate pulse modulation switch GPMS1 may be turned on. During the pulse period corresponding to the pulse width Wm of the modulation clock signal MCLK, the intermediate level voltage AVDD may be applied to the first output terminal Pclk1 through the turned-on first gate pulse modulation switch GPMS1. Before the intermediate level voltage AVDD is applied, the first output terminal Pclk1 may be in a state in which the high level voltage VGH is applied.

Since the on-resistance Ron1 of the first gate pulse modulation switch GPMS1 is large, the voltage of the first output terminal Pclk1 may not rapidly fall from the high level voltage VGH to the middle level voltage AVDD. The time taken for the voltage of the first output terminal Pclk1 to fall to the intermediate level voltage AVDD may be a period corresponding to the pulse width Wm of the modulation clock signal MCLK.

Following the first falling step F-STEP1, the second falling step F-STEP2 may proceed. The second falling step F-STEP2 may be a step in which the voltage of the first clock signal CLK1 is changed from the intermediate level voltage AVDD to the low level voltage VGL by the first falling switch S1*f*.

The second falling step F-STEP2 may be started when the falling time of the first pulse m1 of the modulation clock signal MCLK starts.

When the falling time of the first pulse m1 of the modulation clock signal MCLK comes, the first falling switch S1*f* may be turned on. Accordingly, the low level voltage VGL may be applied to the first output terminal Pclk1 through the turned-on first falling switch S1*f*. Before the low level voltage VGL is applied, the first output terminal Pclk1 may be in a state in which the intermediate level voltage AVDD is applied.

The on-resistance of the first falling switch S1*f* may be smaller than the on-resistance Ron1 of the first gate pulse modulation switch GPMS1. Accordingly, when the first falling switch S1*f* is turned on, the voltage of the first output terminal Pclk1 may be rapidly lowered from the intermediate level voltage AVDD to the low level voltage VGL. A voltage falling slope (voltage falling rate) of the first output terminal Pclk1 in the second polling step F-STEP2 may be steeper (greater) than a voltage falling slope (voltage falling rate) of the first output terminal Pclk1 in the first polling step F-STEP1.

The falling length CF1 of the first clock signal CLK1 may be the sum of the temporal length Wm of the first falling step F-STEP1 and the temporal length of the second falling step F-STEP2.

Next, generation of the second clock signal CLK2 will be described.

Rising of the second clock signal CLK2 may proceed in two steps. The two steps may include a first rising step R-STEP1 and a second rising step R-STEP2.

The first rising step R-STEP1 may be a step in which the voltage of the second clock signal CLK2 is changed from the low level voltage VGL to the intermediate level voltage AVDD by the second gate pulse modulation switch GPMS2.

The first rising step R-STEP1 may be started when the rising time of the second pulse g2 of the generation clock signal GCLK starts, and may proceed during the pulse period Wg of the second pulse g2 of the generation clock signal GCLK.

When the rising time of the second pulse g2 of the generation clock signal GCLK comes, the second gate pulse modulation switch GPMS2 may be turned on. During the pulse period corresponding to the pulse width Wg of the generation clock signal GCLK, the intermediate level voltage AVDD may be applied to the second output terminal Pclk2 through the turned-on second gate pulse modulation switch GPMS2. Before the intermediate level voltage AVDD is applied, the second output terminal Pclk2 may be in a state in which the low level voltage VGL is applied.

Since the on-resistance Ron2 of the second gate pulse modulation switch GPMS2 is large, the voltage of the second output terminal Pclk2 may not rapidly rise from the low level voltage VGL to the intermediate level voltage AVDD. The time taken for the voltage of the second output terminal Pclk2 to rise to the intermediate level voltage AVDD may be a period corresponding to the pulse width Wg of the generation clock signal GCLK.

Following the first rising step R-STEP1, the second rising step R-STEP2 may be performed. The second rising step R-STEP2 may be a step in which the voltage of the second clock signal CLK2 is changed from the intermediate level voltage AVDD to the high level voltage VGH by the second rising switch S2*r*.

The second rising step R-STEP2 may be started when the falling time of the second pulse g2 of the generation clock signal GCLK starts.

When the falling time of the second pulse g2 of the generation clock signal GCLK comes, the second rising switch S2*r* may be turned on. Accordingly, the high level voltage VGH may be applied to the second output terminal Pclk2 through the turned-on second rising switch S2*r*. Before the high level voltage VGH is applied, the second output terminal Pclk2 may be in a state in which the intermediate level voltage AVDD is applied.

The on-resistance of the second rising switch S2*r* may be smaller than the on-resistance Ron2 of the second gate pulse modulation switch GPMS2. Accordingly, when the second rising switch S2*r* is turned on, the voltage of the second output terminal Pclk2 may rapidly increase from the intermediate level voltage AVDD to the high level voltage VGH. A voltage falling slope (voltage falling rate) of the second output terminal Pclk2 in the second polling step F-STEP2 may be steeper (greater) than a voltage falling slope (voltage falling rate) of the second output terminal Pclk2 in the first polling step F-STEP1.

After being changed to the high level voltage VGH, the second output terminal Pclk2 may maintain the high level voltage VGH until the falling start time.

The rising length CR2 of the second clock signal CLK2 may be the sum of the temporal length Wg of the first rising step R-STEP1 and the temporal length of the second rising step R-STEP2.

The falling of the second clock signal CLK2 may also proceed in two steps. The two steps may include a first falling step F-STEP1 and a second falling step F-STEP2.

The first falling step F-STEP1 may be started when the rising time of the second pulse m2 of the modulation clock signal MCLK starts. When the first falling step F-STEP1 starts, the falling of the second clock signal CLK2 may start. Here, the second pulse g2 among the plurality of pulses g1, g2, etc. included in the generation clock signal GCLK may be a pulse that triggers the rising of the second clock signal CLK2. The second pulse m2 among the plurality of pulses m1, m2, etc. included in the modulation clock signal MCLK may be a pulse that triggers the falling of the second clock signal CLK2. In this sense, the second pulse g2 of the generation clock signal GCLK and the second pulse m2 of the modulation clock signal MCLK may be related to each other and involved in generation (rising, falling) of the same second clock signal CLK2.

The first falling step F-STEP1 may be a step in which the voltage of the second clock signal CLK2 is changed from the high level voltage VGH to the intermediate level voltage AVDD by the second gate pulse modulation switch GPMS2.

The first falling step F-STEP1 may be started when the rising time of the second pulse m2 of the modulation clock signal MCLK starts, and may proceed during the pulse period Wm of the second pulse m2 of the modulation clock signal MCLK.

When the rising time of the second pulse m2 of the modulation clock signal MCLK comes, the second gate pulse modulation switch GPMS2 may be turned on. During the pulse period corresponding to the pulse width Wm of the modulation clock signal MCLK, the intermediate level voltage AVDD may be applied to the second output terminal Pclk2 through the turned-on second gate pulse modulation switch GPMS2. Before the intermediate level voltage AVDD is applied, the second output terminal Pclk2 may be in a state in which the high level voltage VGH is applied.

Since the on-resistance Ron2 of the second gate pulse modulation switch GPMS2 is large, the voltage of the second output terminal Pclk2 may not rapidly fall from the high level voltage VGH to the intermediate level voltage AVDD. The time taken for the voltage of the second output terminal Pclk2 to fall to the intermediate level voltage AVDD may be a period corresponding to the pulse width Wm of the modulation clock signal MCLK.

The second falling step F-STEP2 may be a step in which the voltage of the second clock signal CLK2 is changed from the intermediate level voltage AVDD to the low level voltage VGL by the second falling switch 52*f*.

The second falling step F-STEP2 may be started when the falling time of the second pulse m2 of the modulation clock signal MCLK starts.

When the falling timing of the second pulse m2 of the modulation clock signal MCLK comes, the second falling switch S2*f* may be turned on. Accordingly, the low level voltage VGL may be applied to the second output terminal Pclk2 through the turned-on second falling switch S2*f*. Before the low level voltage VGL is applied, the second output terminal Pclk2 may be in a state in which the intermediate level voltage AVDD is applied.

The on-resistance of the second falling switch S2*f* may be smaller than the on-resistance Ron2 of the second gate pulse modulation switch GPMS2. Accordingly, when the second falling switch S2*f* is turned on, the voltage of the second output terminal Pclk2 may be rapidly lowered from the intermediate level voltage AVDD to the low level voltage VGL. A voltage falling slope (voltage falling rate) of the second output terminal Pclk2 in the second polling step F-STEP2 may be steeper (greater) than a voltage falling slope (voltage falling rate) of the second output terminal Pclk2 in the first polling step F-STEP1.

The falling length CF2 of the second clock signal CLK2 may be the sum of the temporal length Wm of the first falling step F-STEP1 and the temporal length of the second falling step F-STEP2.

As described above, the driving timing diagram of FIG. 9 is for a case in which clock control (polling control and rising control) is not performed by the level shifter 300 according to embodiments of the present disclosure. That is, in the driving timing diagram of FIG. 9, it is assumed that the on-resistance Ron1 of the first gate pulse modulation switch GPMS1 and the on-resistance Ron2 of the second gate pulse modulation switch GPMS2 are the same and do not change with time and are constant.

When clock control is not performed by the level shifter 300, the signal waveform and signal characteristic of the first clock signal CLK1 and the signal waveform and signal characteristic of the second clock signal CLK2 may be identical to each other. That is, the falling length CF1 of the first clock signal CLK1 may be equal to the falling length CF2 of the second clock signal CLK2, and the rising length CR2 of the second clock signal CLK2 may be equal to the rising length CR1 of the first clock signal CLK1.

According to embodiments of the present disclosure, the level shifter 300 may perform clock control to compensate the output deviation of the gate driving circuit 130.

According to the clock control of the level shifter 300 performed to compensate the output deviation of the gate driving circuit 130, the signal waveform and signal characteristic of the first clock signal CLK1 and the signal waveform and signal characteristic of the second clock signal CLK2 may be different from each other. For example, the falling length CF1 of the first clock signal CLK1 may be different from the falling length CF2 of the second clock signal CLK2, and/or the rising length CR2 of the second clock signal CLK2 may be different from the rising length CR1 of the first clock signal CLK1.

In order to reduce a deviation in the falling characteristics between the first gate signal Vgout1 and the second gate signal Vgout2, the level shifter 300 may control the falling characteristics of the first clock signal CLK1.

When controlling the falling characteristic of the first clock signal CLK1, the level shifter 300 may control the falling length CF1 of the first clock signal CLK1 to be longer than before the clock control (falling characteristic control). In this case, the falling length CF1 of the first clock signal CLK1 may be longer than the falling length CF2 of the second clock signal CLK2.

As the falling length CF1 of the first clock signal CLK1 increases, the falling length F1 of the first gate signal Vgout1 may increase. Accordingly, the falling length F1 of the first gate signal Vgout1, which is increased according to the clock control, may be equal to or similar to the falling length F2 of the second gate signal Vgout2, which was originally long.

As described above, the difference between the falling length F1 of the first gate signal Vgout1 and the falling length F2 of the second gate signal Vgout2 may be reduced or eliminated. Accordingly, the difference between the falling length F1 of the first gate signal Vgout1 and the falling length F2 of the second gate signal Vgout2 may be smaller than the difference between the falling length CF1 of the first clock signal CLK1 and the falling length CF2 of the second clock signal CLK2.

The level shifter 300 may use one or more of two options to perform clock control so that the falling length CF1 of the first clock signal CLK1 is longer than the falling length CF2 of the second clock signal CLK2. The two options may include a first option for adjusting the on-resistance Ron1 of the first gate pulse modulation switch GPMS1 in the first falling step F-STEP1, and a second option for adjusting the on-resistance of the first falling switch S1*f* in the second falling step F-STEP2.

In order to reduce a deviation in the rising characteristic between the first gate signal Vgout1 and the second gate signal Vgout2, the level shifter 300 may control the rising characteristic of the second clock signal CLK2.

When controlling the rising characteristic of the second clock signal CLK2, the level shifter 300 may control the rising length CR2 of the second clock signal CLK2 to be longer than before the clock control (rising characteristic control). In this case, the rising length CR2 of the second clock signal CLK2 may be longer than the rising length CR1 of the first clock signal CLK1.

Due to the increased rising length CR2 of the second clock signal CLK2, the rising length R2 of the second gate signal Vgout2 may be increased. Accordingly, the increased rising length R2 of the second gate signal Vgout2 may be equal to or similar to the originally long falling length R1 of the first gate signal Vgout1.

As described above, the difference between the rising length R1 of the first gate signal Vgout1 and the rising length R2 of the second gate signal Vgout2 may be reduced or eliminated. Accordingly, the difference between the rising length R1 of the first gate signal Vgout1 and the rising length R2 of the second gate signal Vgout2 may be smaller than the difference between the rising length CR1 of the first clock signal CLK1 and the rising length CR2 of the second clock signal CLK2.

The level shifter 300 may use one or more of the two options to perform clock control so that the rising length CR2 of the second clock signal CLK2 is longer than the rising length CR1 of the first clock signal CLK1. The two options may include a first option for adjusting the on-resistance Ron2 of the second gate pulse modulation switch GPMS2 in the first rising step R-STEP1, and a second option for adjusting the on-resistance of the second rising switch S2*r* in the second rising step R-STEP2.

Below, the falling control of the first clock signal CLK1 of the level shifter 300 will be described in more detail with reference to FIGS. 10, 11A and 11B, and the rising control of the second clock signal CLK2 of the level shifter 300 will be described in more detail with reference to FIGS. 12, 13A and 13B.

Figure 10:
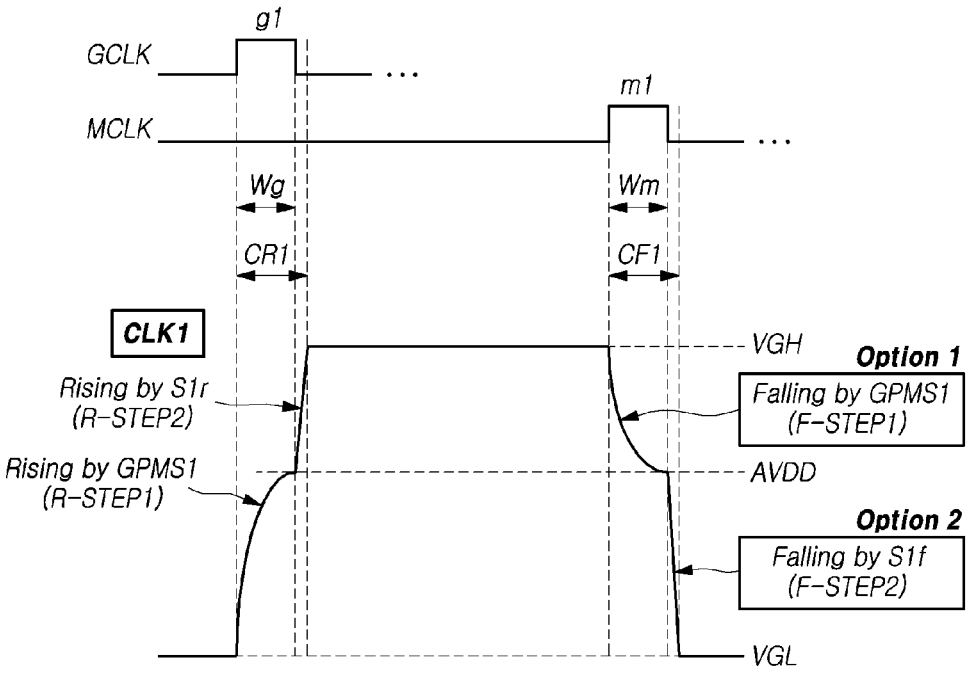
FIG. 10 is a driving timing diagram for explaining two options for falling control of a first clock signal of the level shifter according to embodiments of the present disclosure.

FIG. 10 is a driving timing diagram for explaining two options for falling control of a first clock signal CLK1 of the level shifter 300 according to embodiments of the present disclosure. FIG. 11A is a driving timing diagram illustrating a first option for falling control of the first clock signal CLK1 of the level shifter 300 according to embodiments of the present disclosure. FIG. 11B is a driving timing diagram illustrating a second option for falling control of the first clock signal CLK1 of the level shifter 300 according to embodiments of the present disclosure.

Figure 11A:
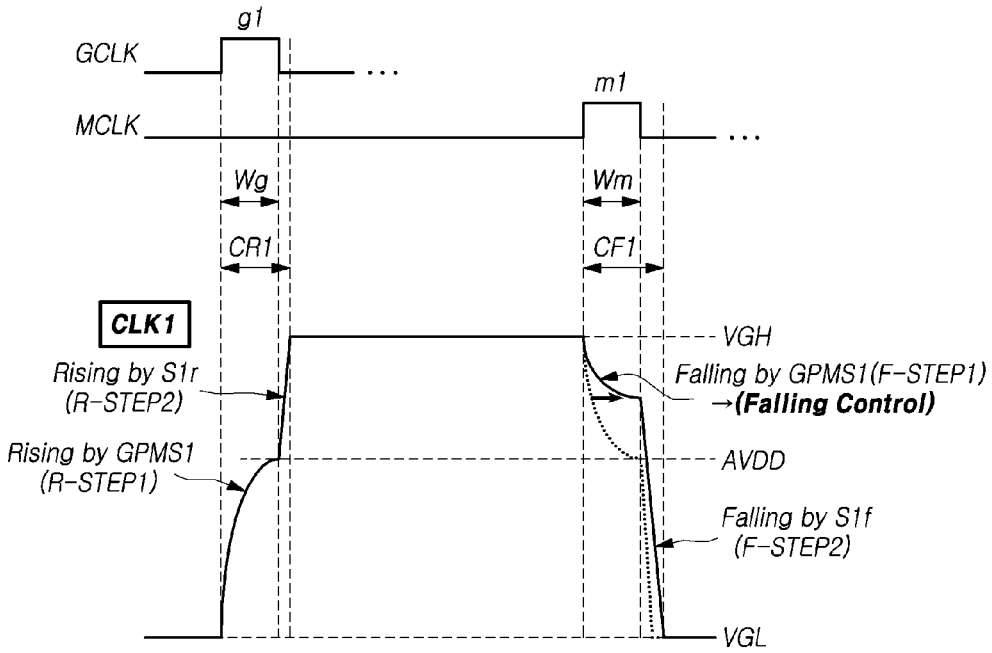
FIG. 11A is a driving timing diagram illustrating a first option for falling control of the first clock signal of the level shifter according to embodiments of the present disclosure.
Figure 11B:
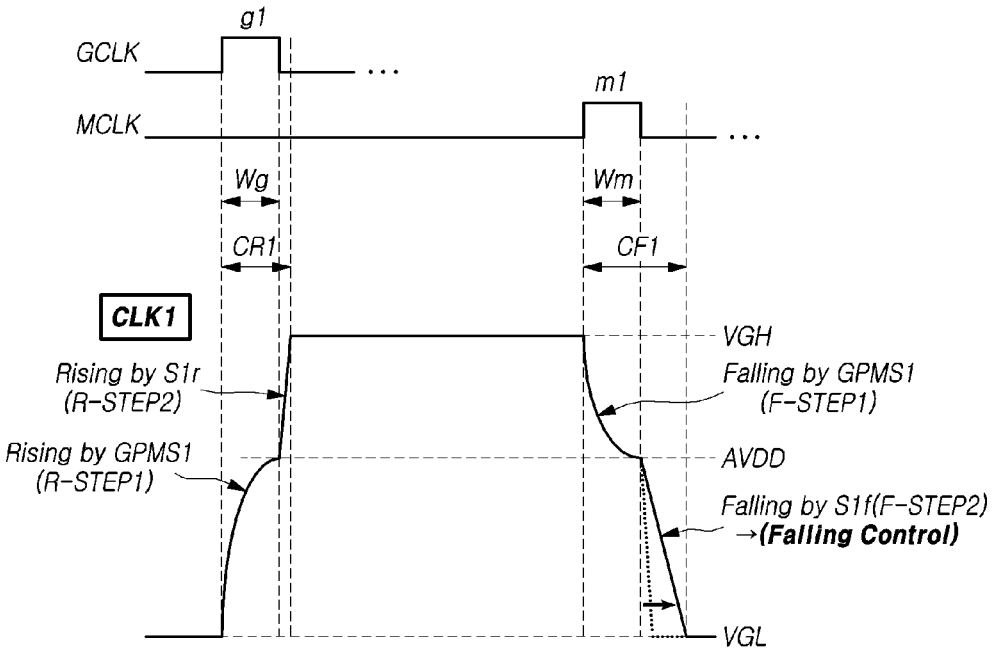
FIG. 11B is a driving timing diagram illustrating a second option for falling control of the first clock signal of the level shifter according to embodiments of the present disclosure.

FIG. 10 shows the first clock signal CLK1 generated without falling control, FIG. 11A shows the first clock signal CLK1 generated by falling control according to the first option, and FIG. 11B shows the first clock signal CLK1 generated by falling control according to the second option.

Referring to FIG. 10, the generation process of the first clock signal CLK1 by the level shifter 300 may include a rising step and a falling step. In the rising step, the level shifter 300 may increase the voltage of the first clock signal CLK1 in two steps (the first rising step R-STEP1, the second rising step R-STEP2) using the first gate pulse modulation switch GPMS1 and the first rising switch S1*r* based on the first pulse g1 of the generation clock signal GCLK. In the falling step, the level shifter 300 may make the voltage of the first clock signal CLK1 fall in two steps (the first falling step F-STEP1, the second falling step F-STEP2) using the first gate pulse modulation switch GPMS1 and the first falling switch S1*f* based on the first pulse m1 of the modulation clock signal MCLK.

Referring to FIG. 10, the rising of the first clock signal CLK1 may be performed in two steps R-STEP1 and R-STEP2, and the first gate pulse modulation switch GPMS1 may be turned on before the first rising switch S1*r*. Furthermore, the falling of the first clock signal CLK1 may be performed in two steps F-STEP1 and F-STEP2), and the first gate pulse modulation switch GPMS1 may be turned on before the first falling switch S1*f*.

The level shifter 300 may use one or more of the two options to perform clock control so that the falling length CF1 of the first clock signal CLK1 becomes longer than the falling length CF2 of the second clock signal CLK2. The two options may include a first option for adjusting the on-resistance Ron1 of the first gate pulse modulation switch GPMS1 in the first falling step F-STEP1, and a second option for adjusting the on-resistance of the first falling switch S1*f* in the second falling step F-STEP2.

Referring to FIG. 11A, in order to perform the first option by the level shifter 300, the on-resistance Ron1 of the first gate pulse modulation switch GPMS1 when the first clock signal CLK1 rises and the on-resistance Ron1 of the first gate pulse modulation switch GPMS1 when the first clock signal CLK1 falls may be independently adjusted.

For example, the on-resistance Ron1 of the first gate pulse modulation switch GPMS1 when the first clock signal CLK1 falls may be adjusted to be greater than the on-resistance Ron1 of the first gate pulse modulation switch GPMS1 when the first clock signal CLK1 rises.

Referring to FIG. 11A, for the first option of making the falling length CF1 of the first clock signal CLK1 longer than the falling length CF2 of the second clock signal CLK2, the on-resistance Ron1 of the first gate pulse modulation switch GPMS1 when the first clock signal CLK1 falls may be adjusted to be greater than the on-resistance Ron2 of the second gate pulse modulation switch GPMS2 when the second clock signal CLK2 falls.

Referring to FIG. 11A, in the first falling step F-STEP1, since the on-resistance Ron1 of the first gate pulse modulation switch GPMS1 involved in the falling of the first clock signal CLK1 is largely adjusted, during the period Wm of the first falling step F-STEP1, the voltage of the first clock signal CLK1 may not fall from the high level voltage VGH to the intermediate level voltage AVDD.

Therefore, in the second falling step F-STEP2, even if the on-resistance of the first falling switch S1*f* involved in the falling of the first clock signal CLK1 is not adjusted, since the voltage of the first clock signal CLK1 starts to fall from a voltage higher than the intermediate level voltage AVDD, it takes longer for the voltage of the first clock signal CLK1 to fall to the low level voltage VGL. Accordingly, by the falling control, the falling length CF1 of the first clock signal CLK1 can become longer. The falling length CF1 of the first clock signal CLK1 made longer by the falling control can be longer than the falling length CF1 of the first clock signal CLK1 when there is no falling control as shown in FIG. 10.

Referring to FIG. 11B, in order to perform the second option by the level shifter 300, the on-resistance of the first falling switch S1*f* may be adjusted at the timing at which the first clock signal CLK1 falls.

Referring to FIG. 11B, for the second option of making the falling length CF1 of the first clock signal CLK1 longer than the falling length CF2 of the second clock signal CLK2, the on-resistance of the first falling switch S1*f* when the first clock signal CLK1 falls may be adjusted to be greater than the on-resistance of the second falling switch S2*f* when the second clock signal CLK2 falls.

Referring to FIG. 11B, in the first falling step F-STEP1, since the on-resistance Ron1 of the first gate pulse modulation switch GPMS1 involved in the falling of the first clock signal CLK1 is not adjusted, during the period Wm of the first falling phase F-STEP1, the voltage of the first clock signal CLK1 can fall from the high level voltage VGH to the intermediate level voltage AVDD.

However, in the second falling step F-STEP2, since the on-resistance of the first falling switch S1*f* involved in the falling of the first clock signal CLK1 is largely adjusted, the voltage of the first clock signal CLK1 may decrease slowly. Accordingly, it may take a long time for the voltage of the first clock signal CLK1 to drop to the low level voltage VGL. Accordingly, the falling length CF1 of the first clock signal CLK1 becomes longer than in the case where there is no falling control as shown in FIG. 10.

Figure 12:
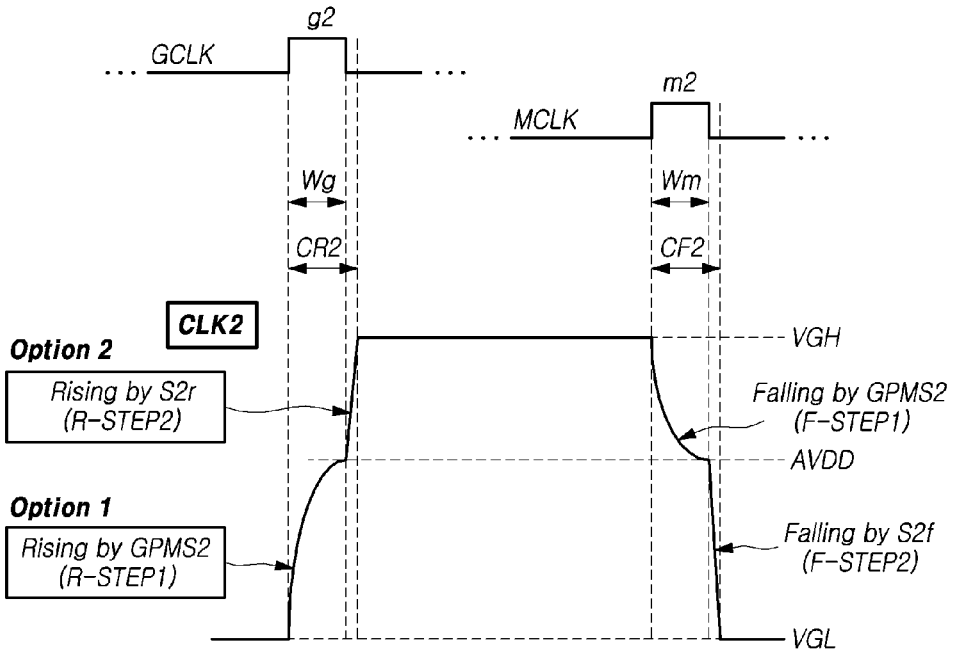
FIG. 12 is a driving timing diagram for explaining two options for rising control of a second clock signal of the level shifter according to embodiments of the present disclosure.

FIG. 12 is a driving timing diagram for explaining two options for rising control of a second clock signal CLK2 of the level shifter 300 according to embodiments of the present disclosure. FIG. 13A is a driving timing diagram illustrating a first option for rising control of the second clock signal CLK2 of the level shifter 300 according to embodiments of the present disclosure. FIG. 13B is a driving timing diagram illustrating a second option for rising control of the second clock signal CLK2 of the level shifter 300 according to embodiments of the present disclosure.

Figure 13A:
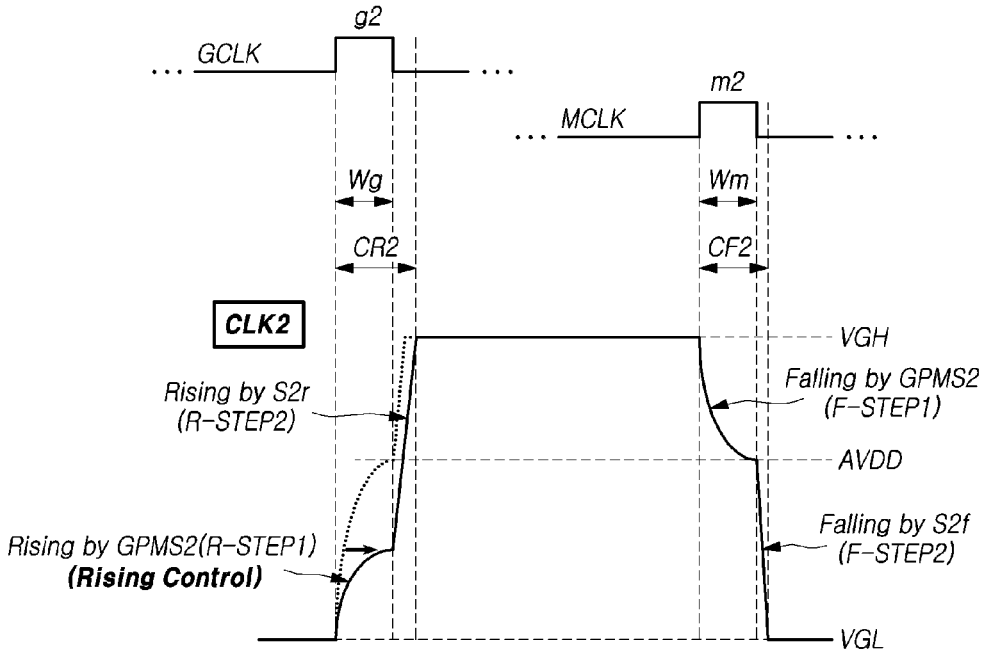
FIG. 13A is a driving timing diagram illustrating a first option for rising control of the second clock signal of the level shifter according to embodiments of the present disclosure.
Figure 13B:
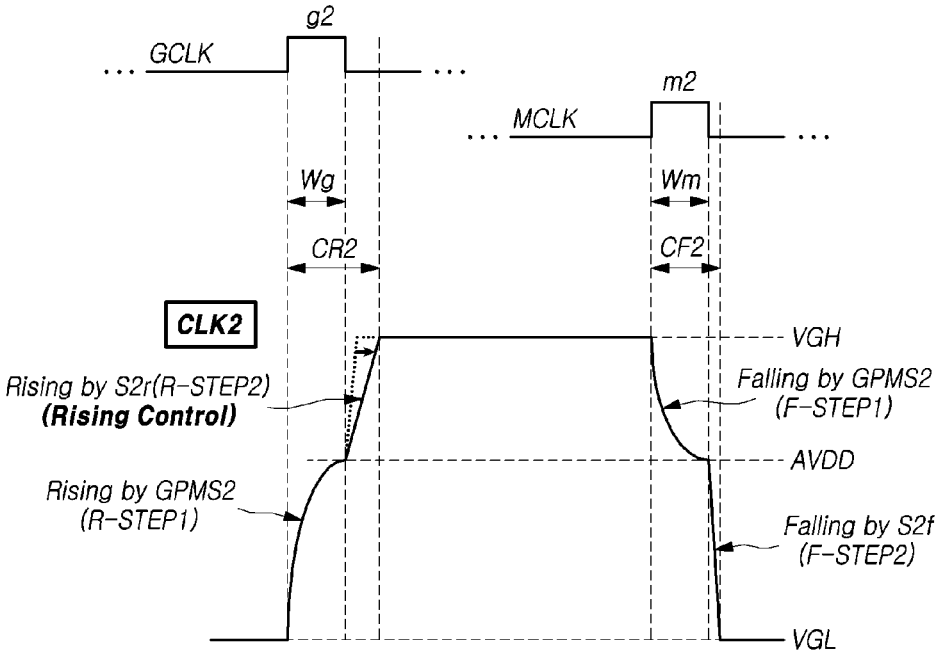
FIG. 13B is a driving timing diagram illustrating a second option for rising control of the second clock signal of the level shifter according to embodiments of the present disclosure.

FIG. 12 shows the second clock signal CLK2 generated without rising control, FIG. 13A shows the second clock signal CLK2 generated by rising control according to the first option, and FIG. 13B shows the second clock signal CLK2 generated by rising control according to the second option.

Referring to FIG. 12, the generation process of the second clock signal CLK2 by the level shifter 300 may include a rising step and a falling step. In the rising step, the level shifter 300 may increase the voltage of the second clock signal CLK2 in two steps (the first rising step R-STEP1, the second rising step R-STEP2) using the second gate pulse modulation switch GPMS2 and the second rising switch S2*r* based on the second pulse g2 of the generation clock signal GCLK. In the falling step, the level shifter 300 may make the voltage of the second clock signal CLK2 fall in two steps (the first falling step F-STEP1, the second falling step F-STEP2) using the second gate pulse modulation switch GPMS2 and the second falling switch S2*f* based on the second pulse m2 of the modulation clock signal MCLK.

Referring to FIG. 12, the rising of the second clock signal CLK2 may be performed in two steps R-STEP1 and R-STEP2. The second gate pulse modulation switch GPMS2 may be turned on before the second rising switch S2*r*. Furthermore, the falling of the second clock signal CLK2 may proceed in two steps F-STEP1 and F-STEP2. The second gate pulse modulation switch GPMS2 may be turned on before the second falling switch S2*f*.

The level shifter 300 may use one or more of the two options to perform clock control such that the rising length CR2 of the second clock signal CLK2 is longer than the rising length CR1 of the first clock signal CLK1. The two options may include a first option for adjusting the on-resistance Ron1 of the second gate pulse modulation switch GPMS2 in the first rising step R-STEP1, and a second option for adjusting the on-resistance of the second rising switch S1*r* in the second rising step R-STEP2.

Referring to FIG. 13A, for the first option, the on-resistance Ron2 of the second gate pulse modulation switch GPMS2 when the second clock signal CLK2 rises and the on-resistance Ron2 of the second gate pulse modulation switch GPMS2 when the second clock signal CLK2 falls may be independently adjusted. The on-resistance Ron2 of the second gate pulse modulation switch GPMS2 when the second clock signal CLK2 rises and the on-resistance Ron2 of the second gate pulse modulation switch GPMS2 when the second clock signal CLK2 falls may be the same or different from each other.

For example, the on-resistance Ron2 of the second gate pulse modulation switch GPMS2 when the second clock signal CLK2 rises may be adjusted to be greater than the on-resistance Ron2 of the second gate pulse modulation switch GPMS2 when the second clock signal CLK2 falls.

Referring to FIG. 13A, for the first option of making the rising length CR2 of the second clock signal CLK2 longer than the rising length CR1 of the first clock signal CLK1, the on-resistance Ron2 of the second gate pulse modulation switch GPMS2 when the second clock signal CLK2 rises may be adjusted to be greater than the on-resistance Ron1 of the first gate pulse modulation switch GPMS1 when the first clock signal CLK1 rises.

Referring to FIG. 13A, in the first rising step R-STEP1, since the on-resistance Ron2 of the second gate pulse modulation switch GPMS2 involved in the rising of the second clock signal CLK2 is largely adjusted, during the period Wg of the first rising step R-STEP1, the voltage of the first clock signal CLK1 does not completely rise from the low level voltage VGL to the intermediate level voltage AVDD.

Therefore, in the second rising step R-STEP2, even if the on-resistance of the second rising switch S1*r* involved in the rising of the second clock signal CLK2 is not adjusted, since the voltage of the second clock signal CLK2 starts to rise at a voltage lower than the intermediate level voltage AVDD, it takes longer for the voltage of the second clock signal CLK2 to rise to the high level voltage VGH. Accordingly, the rising length CR2 of the second clock signal CLK2 can be longer than when there is no rising control as shown in FIG. 12.

Referring to FIG. 13B, in order to perform the second option by the level shifter 300, the on-resistance of the second rising switch S2*r* may be adjusted at the timing at which the second clock signal CLK2 rises.

Referring to FIG. 13B, for the second option of making the rising length CR2 of the second clock signal CLK2 longer than the rising length CR1 of the first clock signal CLK1, the on-resistance of the second rising switch S2*r* when the second clock signal CLK2 rises may be adjusted to be greater than the on-resistance of the first rising switch S1*r* when the first clock signal CLK1 rises.

Referring to FIG. 13B, in the first rising step R-STEP1, the on-resistance Ron2 of the second gate pulse modulation switch GPMS2 involved in the rising of the second clock signal CLK2 may not be adjusted. Accordingly, during the period Wg of the second rising step F-STEP2, the voltage of the second clock signal CLK2 may increase from the low level voltage VGL to the intermediate level voltage AVDD.

However, in the second rising step (R-STEP2), since the on-resistance of the second rising switch S2*r* involved in the rising of the second clock signal CLK2 is largely adjusted, the voltage of the second clock signal CLK2 rises slowly. Accordingly, it may take a long time for the voltage of the second clock signal CLK2 to rise to the high level voltage VGH. Accordingly, the rising length CR2 of the second clock signal CLK2 can become longer than in the case where there is no rising control as shown in FIG. 12.

As described above, the display device 100 according to embodiments of the present disclosure controls the falling characteristic of the first clock signal CLK1 by using a method (on-resistance adjustment method) of largely adjusting the on-resistance of one of the first gate pulse modulation switch GPMS1 and the first falling switch S1*f* included in the level shifter 300. Meanwhile, the display device 100 according to embodiments of the present disclosure may control the falling characteristic of the first clock signal CLK1 by using another method different from the on-resistance adjustment method in the level shifter 300. Hereinafter, another method for controlling the falling characteristic of the first clock signal CLK1 will be described with reference to FIGS. 14A and 14B. Briefly described first, another method of controlling the falling characteristic of the first clock signal CLK1 is that the controller 140 controls the modulation clock signal MCLK so that the level shifter 300 generates the first clock signal CLK1 whose falling characteristic is controlled.

Figure 14A:
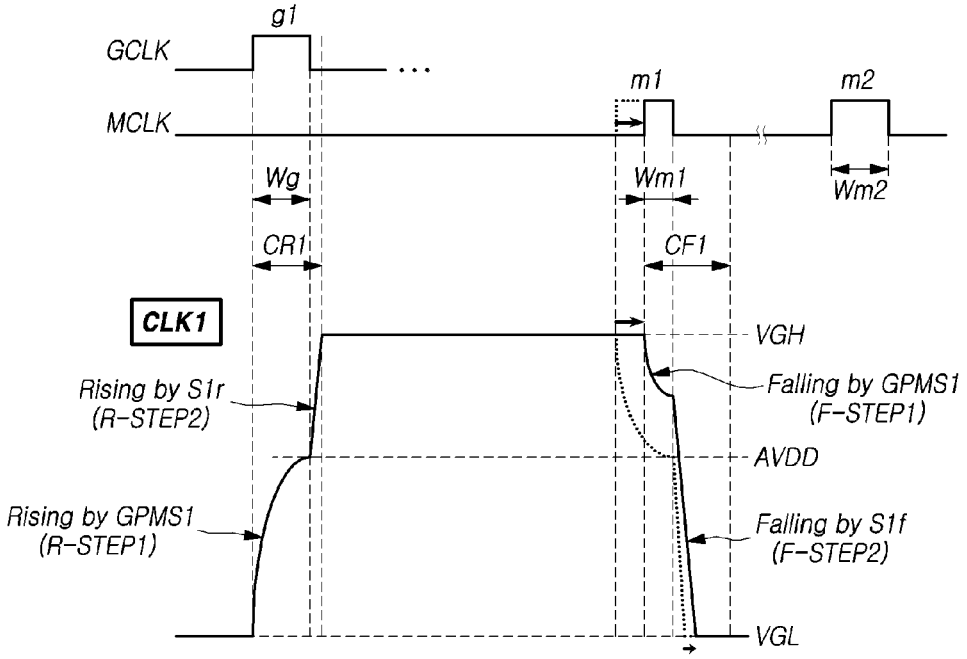
FIG. 14A is a driving timing diagram illustrating the first option for falling control of the first clock signal based on a modulation clock signal output from the controller of the display device according to embodiments of the present disclosure.
Figure 14B:
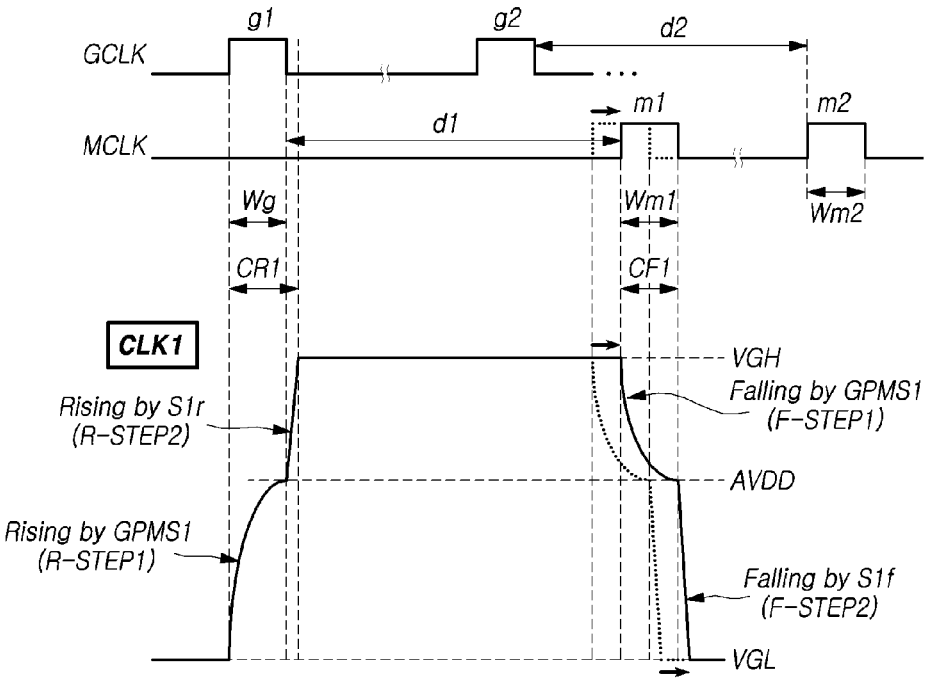
FIG. 14B is a driving timing diagram illustrating the second option for falling control of the first clock signal based on the modulation clock signal output from the controller of the display device according to embodiments of the present disclosure.

FIG. 14A is a driving timing diagram illustrating the first option for falling control of the first clock signal CLK1 based on a modulation clock signal MCLK output from the controller 140 of the display device 100 according to embodiments of the present disclosure. FIG. 14B is a driving timing diagram illustrating the second option for falling control of the first clock signal CLK1 based on the modulation clock signal MCLK output from the controller 140 of the display device 100 according to embodiments of the present disclosure.

Referring to FIGS. 14A and 14B, even if the on-resistance Ron1 of the first gate pulse modulation switch GPMS1 in the level shifter 300 or the on-resistance of the first falling switch S2f is not adjusted, that is, even if there is no change in the level shifter 300, the falling characteristic of the first clock signal CLK1 may be different from the falling characteristic of the second clock signal CLK2.

To this end, the controller 140 performing the driving timing control function may control the modulation clock signal MCLK and provide the controlled modulation clock signal MCLK to the level shifter 300.

Referring to FIG. 14A, the controller 140 may generate and output a modulation clock signal MCLK including a first pulse m1 having a delayed rising time. Here, the first pulse m1 of the modulation clock signal MCLK is a pulse involved in the falling of the first clock signal CLK1. In other words, as the controller 140 controls the rising timing of the first pulse m1 of the modulation clock signal MCLK, the falling characteristic of the first clock signal CLK1 generated and output from the level shifter 300 can be controlled. However, although the controller 140 delays the rising time of the first pulse m1 of the modulation clock signal MCLK, the controller 140 may not delay the falling time of the first pulse m1 of the modulation clock signal MCLK.

Accordingly, as shown in FIG. 14A, the pulse width Wm1 of the first pulse m1 of the modulation clock signal MCLK may be narrower than the pulse width Wm2 of the second pulse m2 of the modulation clock signal MCLK. Here, the first pulse m1 of the modulation clock signal MCLK is a pulse involved in the falling of the first clock signal CLK1, and the second pulse m2 of the modulation clock signal MCLK is a pulse involved in the falling of the second clock signal CLK2.

Accordingly, the level shifter 300 may start late the first falling step F-STEP1 with respect to the first clock signal CLK1. After the first falling step F-STEP1 starts late, the level shifter 300 may proceed with the first falling step F-STEP1 during a short period corresponding to the shortened pulse width Wm1 of the first pulse m1 of the modulation clock signal MCLK.

Accordingly, when the delayed rising time of the first pulse m1 of the modulation clock signal MCLK starts, the voltage of the first clock signal CLK1 may start to fall from the high level voltage VGH. In addition, the voltage of the first clock signal CLK1 may decrease during a short period corresponding to the shortened pulse width Wm1 of the first pulse m1 of the modulation clock signal MCLK.

Since the voltage of the first clock signal CLK1 falls during a short period corresponding to the shortened pulse width Wm1 of the first pulse m1 of the modulation clock signal MCLK, the voltage of the first clock signal CLK1 may not fall from the high level voltage VGH to the intermediate level voltage AVDD. Accordingly, during the first falling step F-STEP1, the voltage of the first clock signal CLK1 may only fall to a voltage higher than the intermediate level voltage AVDD.

Accordingly, in the second falling step F-STEP2 of the first clock signal CLK1, the voltage of the first clock signal CLK1 may start to fall at the voltage higher than the intermediate level voltage AVDD. Accordingly, the falling completion time point at which the voltage of the first clock signal CLK1 falls to the low level voltage VGL may be later than the falling completion time point when there is no falling control.

As described above, the falling characteristic of the first clock signal CLK1 may be controlled by delaying the rising time of the first pulse m1 of the modulation clock signal MCLK and maintaining the falling time of the first pulse m1 of the modulation clock signal MCLK. The falling completion time of the first clock signal CLK1 according to the above-described falling control may be later than the falling completion time of the first clock signal CLK1 when the falling control is not performed. According to the above-described falling control, the delayed falling completion time of the first clock signal CLK1 may be later than the falling completion time of the second clock signal CLK2 to which the falling control is not performed.

Referring to FIG. 14B, the controller 140 may generate and output the modulation clock signal MCLK including the delayed first pulse m1 by shifting both the rising timing and the falling timing equally. The first pulse m1 of the modulation clock signal MCLK is a pulse involved in the falling of the first clock signal CLK1.

Therefore, as shown in FIG. 14B, the interval d1 between the first pulse g1 of the generation clock signal GCLK and the first pulse m1 of the modulation clock signal MCLK may be longer than the interval d2 between the second pulse g2 of the generation clock signal GCLK and the second pulse m2 of the modulation clock signal MCLK. Here, the first pulse m1 of the modulation clock signal MCLK is a pulse involved in the falling of the first clock signal CLK1, and the second pulse m2 of the modulation clock signal MCLK is a pulse involved in the falling of the second clock signal CLK2.

Referring to FIG. 14B, the pulse width Wm1 of the first pulse m1 of the modulation clock signal MCLK may be the same as the pulse width Wm2 of the second pulse m2 of the modulation clock signal MCLK.

Referring to FIG. 14B, according to the shift of the first pulse m1 of the modulation clock signal MCLK, the level shifter 300 may start late the first falling step F-STEP1 with respect to the first clock signal CLK1. And the level shifter 300 may proceed with the first falling step F-STEP1 during a period corresponding to the pulse width Wm1 of the first pulse m1 of the modulation clock signal MCLK.

Accordingly, when the shifted rising time of the first pulse m1 of the modulation clock signal MCLK starts, the voltage of the first clock signal CLK1 may start to fall from the high level voltage VGH. And, during a period corresponding to the pulse width Wm1 of the first pulse m1 of the modulation clock signal MCLK, the voltage of the first clock signal CLK1 may fall from the high level voltage VGH.

At this time, since the pulse width Wm1 of the first pulse m1 of the modulation clock signal MCLK does not change, the voltage of the first clock signal CLK1 may fall from the high level voltage VGH to the intermediate level voltage AVDD.

Thereafter, in the second falling stage F-STEP2 of the first clock signal CLK1, the voltage of the first clock signal CLK1 may start to fall from the intermediate level voltage AVDD. Accordingly, the time period during which the second falling step F-STEP2 of the first clock signal CLK1 proceeds may not change. That is, the temporal length of the second falling step F-STEP2 of the first clock signal CLK1 may not be changed. As described above, since the first pulse m1 of the modulation clock signal MCLK is entirely shifted, the falling completion time of the first clock signal CLK1 may not change. Here, the falling completion time of the first clock signal CLK1 may be the time it takes for the voltage of the first clock signal CLK1 to completely fall from the high level voltage VGH to the low level voltage VGL through the middle level voltage AVDD. The falling completion time of the first clock signal CLK1 when the falling control is performed may be the same as the falling completion time of the first clock signal CLK1 when there is no falling control.

However, according to the shift of the first pulse m1 of the modulation clock signal MCLK, since the falling start time of the first clock signal CLK1 is delayed, the falling completion time of the first clock signal CLK1 may be delayed compared to the case where there is no falling control. Here, the delayed falling completion time of the first clock signal CLK1 may be later than the falling completion time of the second clock signal CLK2.

As described above, the level shifter 300 may control the falling length CF1 of the first clock signal CLK1 to be long by largely adjusting the on-resistance Ron1 of the first gate pulse modulation switch GPMS1 or the on-resistance of the first falling switch S1*f*.

Hereinafter, two techniques for largely adjusting the on-resistance Ron1 of the first gate pulse modulation switch GPMS1 will be described with reference to FIGS. 15A, 15B, 16A and 16B. The first technique of the two techniques will be described with reference to FIGS. 15A and 15B, and the second technique of the two techniques will be described with reference to FIGS. 16A and 16B. Hereinafter, the first technique may be referred to as a switch split technique or a circuit structure utilization technique. The second technique may be referred to as a Vgs control technique or a gate voltage control technique.

Figure 15A:
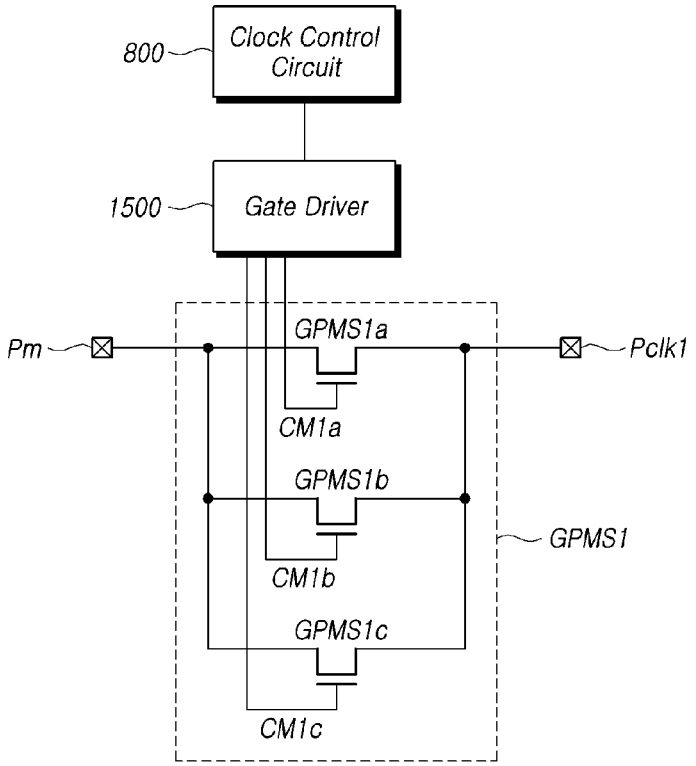
FIG. 15A is a diagram illustrating a switch split technique for adjusting on-resistance of the first gate pulse modulation switch of the level shifter according to embodiments of the present disclosure.
Figure 15B:
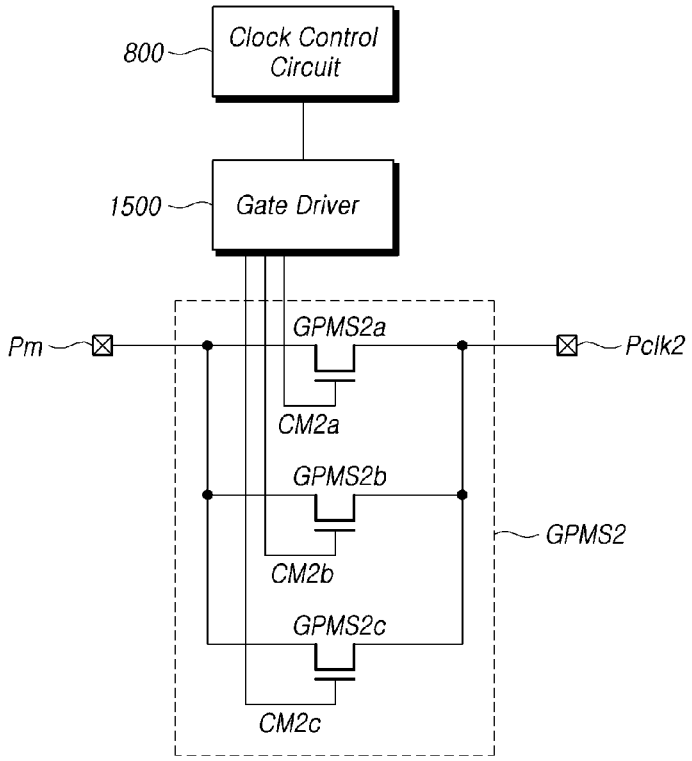
FIG. 15B is a diagram illustrating a switch split technique for adjusting on-resistance of the second gate pulse modulation switch of the level shifter according to embodiments of the present disclosure.

FIG. 15A is a diagram illustrating a switch split technique for adjusting on-resistance Ron1 of the first gate pulse modulation switch GPMS1 of the level shifter 300 according to embodiments of the present disclosure. FIG. 15B is a diagram illustrating a switch split technique for adjusting on-resistance Ron2 of the second gate pulse modulation switch GPMS2 of the level shifter 300 according to embodiments of the present disclosure.

Referring to FIG. 15A, the first gate pulse modulation switch GPMS1 may include two or more first sub-switches GPMS1*a*, GPMS1*b*, and GPMS1*c* connected in parallel between the intermediate input terminal Pm and the first output terminal Pclk1.

Referring to FIG. 15A, two or more first sub-switches GPMS1*a*, GPMS1*b*, and GPMS1*c* may be independently controlled on-off.

To this end, the level shifter 300 may include the clock control circuit 800 and a gate driver 1500. Here, the gate driver 1500 may be included outside or inside the clock control circuit 800.

The gate driver 1500 may output first control signals CM1*a*, CM1*b*, and CM1*c* for controlling the on-off of each of the two or more first sub-switches GPMS1*a*, GPMS1*b*, and GPMS1*c* under the control of the clock control circuit 800. The first control signals CM1*a*, CM1*b*, and CM1*c* may be applied to a control node (gate electrode) of each of the two or more first sub-switches GPMS1*a*, GPMS1*b*, and GPMS1*c*.

By adjusting the number of first sub-switches that are turned on among two or more first sub-switches GPMS1*a*, GPMS1*b*, and GPMS1*c*, the on-resistance Ron1 of the first gate pulse modulation switch GPMS1 may be adjusted.

When the number of turned-on first sub-switches among the two or more first sub-switches GPMS1*a*, GPMS1*b*, and GPMS1*c* increases, the on-resistance Ron1 of the first gate pulse modulation switch GPMS1 may decrease. When the number of turned-on first sub-switches among the two or more first sub-switches GPMS1*a*, GPMS1*b*, and GPMS1*c* decreases, the on-resistance Ron1 of the first gate pulse modulation switch GPMS1 may increase.

That is, the on-resistance Ron1 of the first gate pulse modulation switch GPMS1 may be inversely proportional to the number of first sub-switches that are turned on among the two or more first sub-switches GPMS1*a*, GPMS1*b*, and GPMS1*c*.

Referring to FIG. 15B, the second gate pulse modulation switch GPMS2 may include two or more second sub-switches GPMS2*a*, GPMS2*b*, and GPMS2*c* connected in parallel between the intermediate input terminal Pm and the second output terminal Pclk2.

Referring to FIG. 15B, two or more second sub-switches GPMS2*a*, GPMS2*b*, and GPMS2*c* may be independently controlled on-off.

The gate driver 1500 may output second control signals CM2*a*, CM2*b*, and CM2*c* for controlling the on-off of each of the two or more second sub-switches GPMS2*a*, GPMS2*b*, and GPMS2*c* under the control of the clock control circuit 800. The second control signals CM2*a*, CM2*b*, and CM2*c* may be applied to a control node (gate electrode) of each of the two or more second sub-switches GPMS2*a*, GPMS2*b*, and GPMS2*c*.

By adjusting the number of second sub-switches that are turned on among two or more second sub-switches GPMS2*a*, GPMS2*b*, and GPMS2*c*, the on-resistance Ron2 of the second gate pulse modulation switch GPMS2 may be adjusted.

When the number of the second sub-switches that are turned on among the two or more second sub-switches GPMS2*a*, GPMS2*b*, and GPMS2*c* increases, the on-resistance Ron2 of the second gate pulse modulation switch GPMS2 may decrease. When the number of turned-on second sub-switches among the two or more second sub-switches GPMS2*a*, GPMS2*b*, and GPMS2*c* decreases, the on-resistance Ron2 of the second gate pulse modulation switch GPMS2 may increase.

That is, the on-resistance Ron2 of the second gate pulse modulation switch GPMS2 may be inversely proportional to the number of the second sub-switches that are turned on among the two or more second sub-switches GPMS2*a*, GPMS2*b*, and GPMS2*c*.

The clock control circuit 800 may adjust the number (e.g., 1) of first sub-switches turned on at the falling of the first clock signal CLK1 to be less than the number (e.g., 3) of second sub-switches turned on at the falling of the second clock signal CLK2. Therefore, the on-resistance Ron1 of the first gate pulse modulation switch GPMS1 when the first clock signal CLK1 falls may be adjusted to be greater than the on-resistance Ron2 of the second gate pulse modulation switch GPMS2 when the second clock signal CLK2 falls. Accordingly, the falling length CF1 of the first clock signal CLK1 may be increased.

The clock control circuit 800 may control the number (e.g., 1) of second sub-switches turned on when the second clock signal CLK2 rises less than the number (e.g., 3) of first sub-switches turned on when the first clock signal CLK1 rises. Accordingly, the on-resistance Ron2 of the second gate pulse modulation switch GPMS2 when the second clock signal CLK2 rise may be greater than the on-resistance Ron1 of the first gate pulse modulation switch GPMS1 when the first clock signal CLK1 rises. Accordingly, the rising length CR2 of the second clock signal CLK2 may be increased.

As described above, the on-resistance Ron1 of the first gate pulse modulation switch GPMS1 may be adjusted through the switch split technique for the first gate pulse modulation switch GPMS1. Here, the switch split technology is a technology that controls the number of turned-on switches.

Similar to the switch split technology for the first gate pulse modulation switch GPMS1, the on-resistance of the first falling switch S1*f* can be adjusted by applying the switch split technology for the first falling switch S1*f*.

Figure 16A:
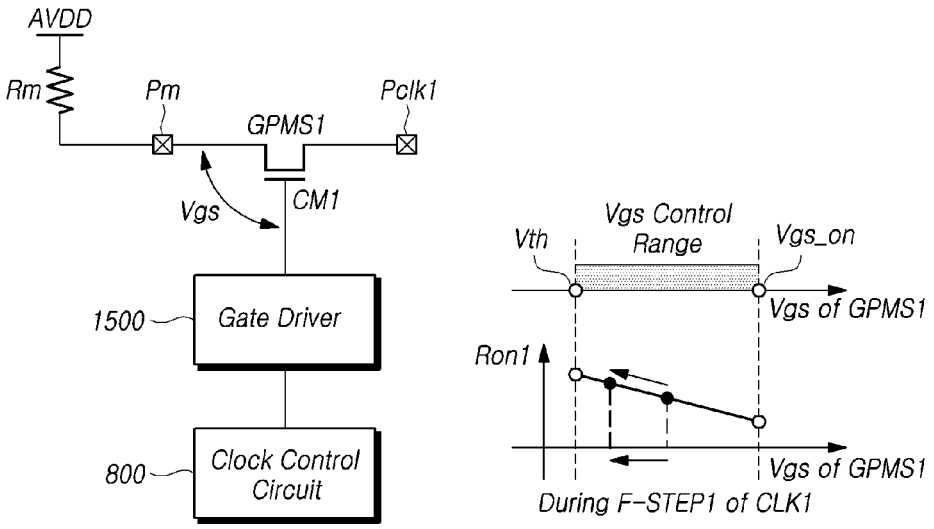
FIG. 16A is a diagram for explaining a gate-source voltage Vgs control technique for adjusting an on-resistance of the first gate pulse modulation switch of the level shifter according to embodiments of the present disclosure.
Figure 16B:
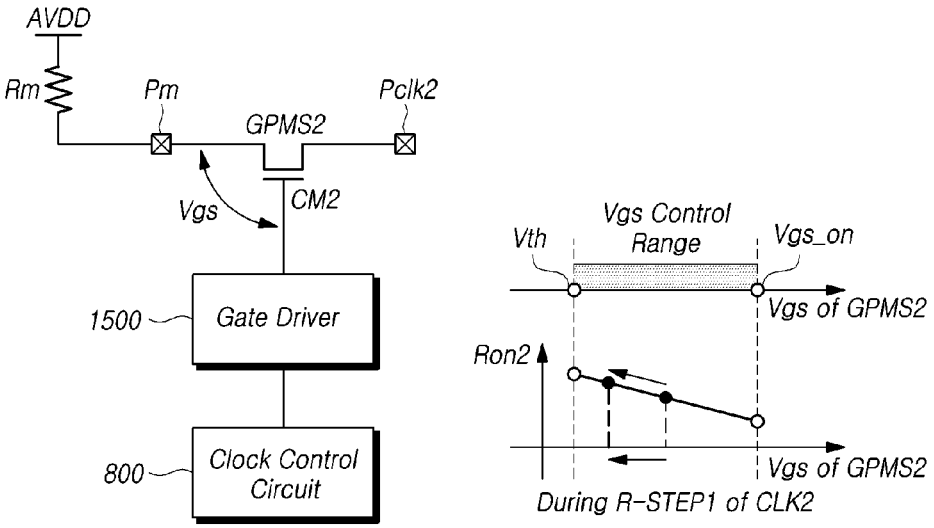
FIG. 16B is a diagram for explaining a gate-source voltage Vgs control technique for adjusting an on-resistance of the second gate pulse modulation switch of the level shifter according to embodiments of the present disclosure.

FIG. 16A is a diagram for explaining a Vgs control technique for adjusting an on-resistance Ron1 of the first gate pulse modulation switch GPMS1 of the level shifter 300 according to embodiments of the present disclosure. FIG. 16B is a diagram for explaining a Vgs control technique for adjusting an on-resistance Ron2 of the second gate pulse modulation switch GPMS2 of the level shifter 300 according to embodiments of the present disclosure.

Referring to FIG. 16A, the first gate pulse modulation switch GPMS1 may be connected between the intermediate input terminal Pm and the first output terminal Pclk1. When the first gate pulse modulation switch GPMS1 is a transistor, the source electrode (or the drain electrode) of the first gate pulse modulation switch GPMS1 may be electrically connected to the intermediate input terminal Pm to which the intermediate level voltage AVDD is input, the drain electrode (or the source electrode) of the first gate pulse modulation switch GPMS1 may be electrically connected to the first output terminal Pclk1 to which the first clock signal CLK1 is output, and a gate electrode of the first gate pulse modulation switch GPMS1 may be electrically connected to the gate driver 1500.

Referring to FIG. 16A, the clock control circuit 800 may control a first gate voltage corresponding to the first intermediate control signal CM1 for controlling on-off of the first gate pulse modulation switch GPMS1, and may supply the first intermediate control signal CM1 corresponding to the controlled first gate voltage to the control node (gate electrode) of the first gate pulse modulation switch GPMS1 through the gate driver 1500. Accordingly, the on-resistance Ron1 of the first gate pulse modulation switch GPMS1 may vary according to the first gate voltage.

Referring to FIG. 16A, an on/off state of the first gate pulse modulation switch GPMS1 may be determined according to the magnitude of the gate-source voltage Vgs, which is a potential difference between the gate electrode and the source electrode of the first gate pulse modulation switch GPMS1.

When the gate-source voltage Vgs of the first gate pulse modulation switch GPMS1 is greater than or equal to the threshold voltage Vth of the first gate pulse modulation switch GPMS1, the first gate pulse modulation switch GPMS1 may be turned on.

When the gate-source voltage Vgs of the first gate pulse modulation switch GPMS1 becomes a full turn-on voltage Vgs_on higher than the threshold voltage Vth, the first gate pulse modulation switch GPMS1 may be completely turned on to allow a current to flow normally. Here, the complete turn-on voltage Vgs_on may be a gate-source voltage in a state in which the first gate pulse modulation switch GPMS1 can flow a maximum current.

Also, the turn-on degree of the first gate pulse modulation switch GPMS1 may vary according to the magnitude of the gate-source voltage Vgs of the first gate pulse modulation switch GPMS1. That is, according to the magnitude of the gate-source voltage Vgs of the first gate pulse modulation switch GPMS1, even when the first gate pulse modulation switch GPMS1 is turned on, the amount of current flowing through the first gate pulse modulation switch GPMS1 may vary.

As such, the on-resistance Ron1 of the first gate pulse modulation switch GPMS1 may vary according to the magnitude of the gate-source voltage Vgs of the first gate pulse modulation switch GPMS1.

For example, as the gate-source voltage Vgs of the first gate pulse modulation switch GPMS1 decreases and approaches the threshold voltage Vth, the on-resistance Ron1 of the first gate pulse modulation switch GPMS1 may increase. As the gate-source voltage Vgs of the first gate pulse modulation switch GPMS1 increases and approaches the full turn-on voltage Vgs_on, the on-resistance Ron1 of the first gate pulse modulation switch GPMS1 may decrease.

Referring to FIG. 16B, the second gate pulse modulation switch GPMS2 may be connected between the intermediate input terminal Pm and the second output terminal Pclk2. When the second gate pulse modulation switch GPMS2 is a transistor, the source electrode or the drain electrode of the second gate pulse modulation switch GPMS2 may be electrically connected to the intermediate input terminal Pm to which the intermediate level voltage AVDD is input, the drain electrode or the source electrode of the second gate pulse modulation switch GPMS2 may be electrically connected to the second output terminal Pclk2 to which the second clock signal CLK2 is output, and a gate electrode of the second gate pulse modulation switch GPMS2 may be electrically connected to the gate driver 1500.

Referring to FIG. 16B, the clock control circuit 800 may control the second gate voltage corresponding to the second intermediate control signal CM2 for controlling the on-off of the second gate pulse modulation switch GPMS2, and may supply the second intermediate control signal CM2 corresponding to the controlled second gate voltage to the control node (gate electrode) of the second gate pulse modulation switch GPMS2 through the gate driver 1500. Accordingly, the on-resistance Ron2 of the second gate pulse modulation switch GPMS2 may vary according to the second gate voltage.

Referring to FIG. 16B, on/off of the second gate pulse modulation switch GPMS2 may be determined according to the magnitude of the gate-source voltage Vgs, which is a potential difference between the gate electrode and the source electrode of the second gate pulse modulation switch GPMS2.

When the gate-source voltage Vgs of the second gate pulse modulation switch GPMS2 is greater than or equal to the threshold voltage Vth of the second gate pulse modulation switch GPMS2, the second gate pulse modulation switch GPMS2 may be turned on.

When the gate-source voltage Vgs of the second gate pulse modulation switch GPMS2 becomes a full turn-on voltage Vgs_on having a high threshold voltage Vth, the second gate pulse modulation switch GPMS2 may be completely turned on to allow a current to flow normally Here, the complete turn-on voltage Vgs_on may be a gate-source voltage in a state in which the second gate pulse modulation switch GPMS2 can flow a maximum current.

Also, the turn-on degree of the second gate pulse modulation switch GPMS2 may vary according to the magnitude of the gate-source voltage Vgs of the second gate pulse modulation switch GPMS2. That is, according to the magnitude of the gate-source voltage Vgs of the second gate pulse modulation switch GPMS2, even when the second gate pulse modulation switch GPMS2 is turned on, the amount of current flowing through the second gate pulse modulation switch GPMS2 may vary.

As described above, the on-resistance Ron2 of the second gate pulse modulation switch GPMS2 may vary according to the magnitude of the gate-source voltage Vgs of the second gate pulse modulation switch GPMS2.

For example, as the gate-source voltage Vgs of the second gate pulse modulation switch GPMS2 decreases and approaches the threshold voltage Vth, the on-resistance Ron2 of the second gate pulse modulation switch GPMS2 may increase. As the gate-source voltage Vgs of the second gate pulse modulation switch GPMS2 increases and approaches the full turn-on voltage Vgs_on, the on-resistance Ron2 of the second gate pulse modulation switch GPMS2 may decrease.

The clock control circuit 800 may lower Vgs of the first gate pulse modulation switch GPMS1 when the first clock signal CLK1 falls than Vgs of the second gate pulse modulation switch GPMS2 when the second clock signal CLK2 falls. Accordingly, the on-resistance Ron1 of the first gate pulse modulation switch GPMS1 when the first clock signal CLK1 falls may be adjusted to be greater than the on-resistance Ron2 of the second gate pulse modulation switch GPMS2 when the second clock signal CLK2 falls. Accordingly, the falling length CF1 of the first clock signal CLK1 may be increased.

The clock control circuit 800 may lower Vgs of the second gate pulse modulation switch GPMS2 when the second clock signal CLK2 rises than Vgs of the first gate pulse modulation switch GPMS1 when the first clock signal CLK1 rises. Accordingly, the on-resistance Ron2 of the second gate pulse modulation switch GPMS2 when the second clock signal CLK2 rises may be adjusted to be greater than the on-resistance Ron1 of the first gate pulse modulation switch GPMS1 when the first clock signal CLK1 rises. Accordingly, the rising length CR2 of the second clock signal CLK2 may be increased.

As described above, the on-resistance Ron1 of the first gate pulse modulation switch GPMS1 may be adjusted through the Vgs control technique for the first gate pulse modulation switch GPMS1.

In the same way as the Vgs control technique for the first gate pulse modulation switch GPMS1, the on-resistance of the first falling switch S1*f* may be adjusted by applying the Vgs control technique for the first falling switch S1*f*.

In the above, when the gate driving circuit 130 has a structure in which two gate output buffer circuits GBUF1 and GBUF2 share one Q node, as shown in FIG. 5, a method for compensating for gate output deviation and the level shifter 300 have been described.

Below, when the gate driving circuit 130 has a structure in which four gate output buffer circuits GBUF1 to GBUF4 share one Q node, a method of compensating for a gate output deviation and a level shifter 300 will be briefly described. In the above description, overlapping parts are omitted, and the content that differs is briefly explained.

Figure 17:
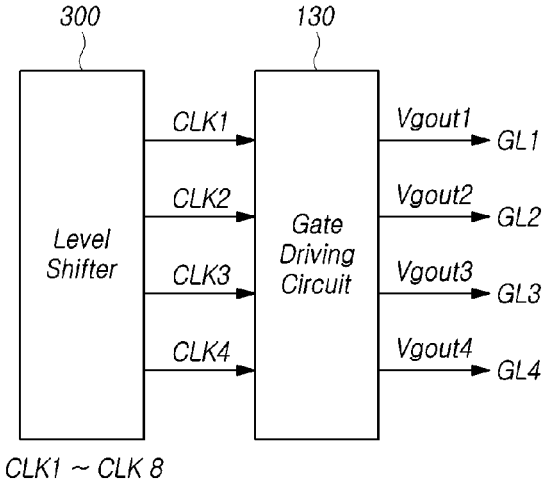
FIG. 17 illustrates a gate signal output system of the display device according to embodiments of the present disclosure.
Figure 18:
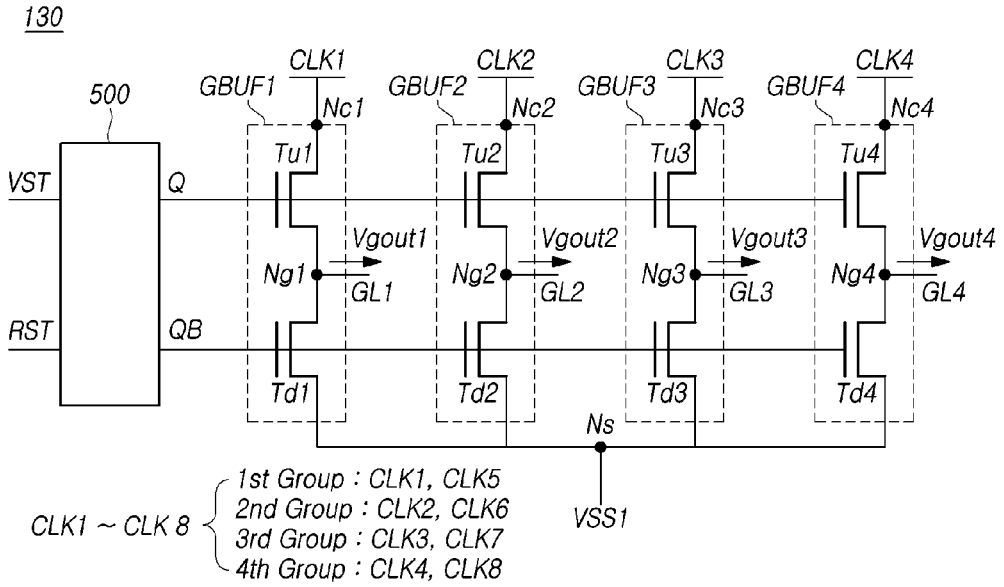
FIG. 18 is a gate driving circuit having a structure in which four gate output buffer circuits share one Q node in the display device according to embodiments of the present disclosure.

FIG. 17 illustrates a gate signal output system of the display device 100 according to embodiments of the present disclosure. FIG. 18 is a gate driving circuit 300 having a structure in which four gate output buffer circuits GBUF1 to GBUF4 share one Q node in the display device 100 according to embodiments of the present disclosure.

Referring to FIG. 17, the level shifter 300 may output four clock signals CLK1 to CLK4. The gate driving circuit 130 may output the four gate signals Vgout1 to Vgout4 to the four gate lines GL1 to GL4 based on the four clock signals CLK1 to CLK4.

Referring to FIG. 18, the gate driving circuit 130 may include first to fourth gate output buffer circuits GBUF1 to GBUF4 and a control circuit 400 for controlling the first to fourth gate output buffer circuits GBUF1 to GBUF4.

The first gate output buffer circuit GBUF1 may output the first gate signal Vgout1 to the first gate line GL1 through the first gate output terminal Ng1 based on the first clock signal CLK1 input to the first clock input terminal Nc1.

The first gate output buffer circuit GBUF1 may include a first pull-up transistor Tu1 electrically connected between the first clock input terminal Nc1 and the first gate output terminal Ng1 and controlled by the voltage of the Q node, and a first pull-down transistor Td1 electrically connected between the first gate output terminal Ng1 and the ground input terminal Ns to which the ground voltage VSS1 is input, and controlled by the voltage of the QB node.

The second gate output buffer circuit GBUF2 may output the second gate signal Vgout2 to the second gate line GL2 through the second gate output terminal Ng2 based on the second clock signal CLK2 input to the second clock input terminal Nc2.

The second gate output buffer circuit GBUF2 may include a second pull-up transistor Tu2 electrically connected between the second clock input terminal Nc2 and the second gate output terminal Ng2 and controlled by the voltage of the Q node, and a second pull-down transistor Td2 electrically connected between the second gate output terminal Ng2 and the ground input terminal Ns and controlled by the voltage of the QB node.

The third gate output buffer circuit GBUF3 may output the third gate signal Vgout3 to the third gate line GL3 through the third gate output terminal Ng3 based on the third clock signal CLK3 input to the third clock input terminal Nc3.

The third gate output buffer circuit GBUF3 may include a third pull-up transistor Tu3 electrically connected between the third clock input terminal Nc3 and the third gate output terminal Ng3 and controlled by the voltage of the Q node, and a third pull-down transistor Td3 electrically connected between the third gate output terminal Ng3 and the ground input terminal Ns and controlled by the voltage of the QB node.

The fourth gate output buffer circuit GBUF4 may output the fourth gate signal Vgout4 to the fourth gate line GL4 through the fourth gate output terminal Ng4 based on the fourth clock signal CLK4 input to the fourth clock input terminal Nc4.

The fourth gate output buffer circuit GBUF4 may include a fourth pull-up transistor Tu4 electrically connected between the fourth clock input terminal Nc4 and the fourth gate output terminal Ng4 and controlled by the voltage of the Q node, and a fourth pull-down transistor Td4 electrically connected between the fourth gate output terminal Ng4 and the ground input terminal Ns and controlled by the voltage of the QB node.

For example, when the gate driving circuit 130 performs gate driving in eight phases, the level shifter 300 may generate and output eight clock signals CLK1, CLK2, CLK3, CLK4, CLK5, CLK6, CLK7, and CLK8. And the gate driving circuit 130 may perform gate driving using eight clock signals CLK1, CLK2, CLK3, CLK4, CLK5, CLK6, CLK7, and CLK8.

As in the above example, when the gate driving circuit 130 performs gate driving in 8 phases and has a structure in which four gate output buffer circuits GBUF1 to GBUF4 share one Q node, as shown in FIG. 18, the eight clock signals CLK1, CLK2, CLK3, CLK4, CLK5, CLK6, CLK7, and CLK8 may be grouped into first to fourth groups. The first and fifth clock signals CLK1 and CLK5 included in the first group may have the same signal characteristics. The first and fifth clock signals CLK1 and CLK5 included in the first group may be input to the first gate output buffer circuits GBUF1 connected to different Q nodes to be used to generate the first and fifth gate signals. The second and sixth clock signals CLK2 and CLK6 included in the second group may have the same signal characteristics. The second and sixth clock signals CLK2 and CLK6 included in the second group may be input to the second gate output buffer circuits GBUF2 connected to different Q nodes and used to generate the second and sixth gate signals. The third and seventh clock signals CLK3 and CLK7 included in the third group may have the same signal characteristics. The third and seventh clock signals CLK3 and CLK7 included in the third group may be input to the third gate output buffer circuits GBUF3 connected to different Q nodes and used to generate the third and seventh gate signals. The fourth and eighth clock signals CLK4 and CLK8 included in the fourth group may have the same signal characteristics. The fourth and eighth clock signals CLK4 and CLK8 included in the fourth group may be input to the fourth gate output buffer circuits GBUF4 connected to different Q nodes and used to generate the fourth and eighth gate signals. Accordingly, below, the first to fourth clock signals CLK1 to CLK4 are described as representative clock signals of the first to fourth groups, respectively.

Figure 19:
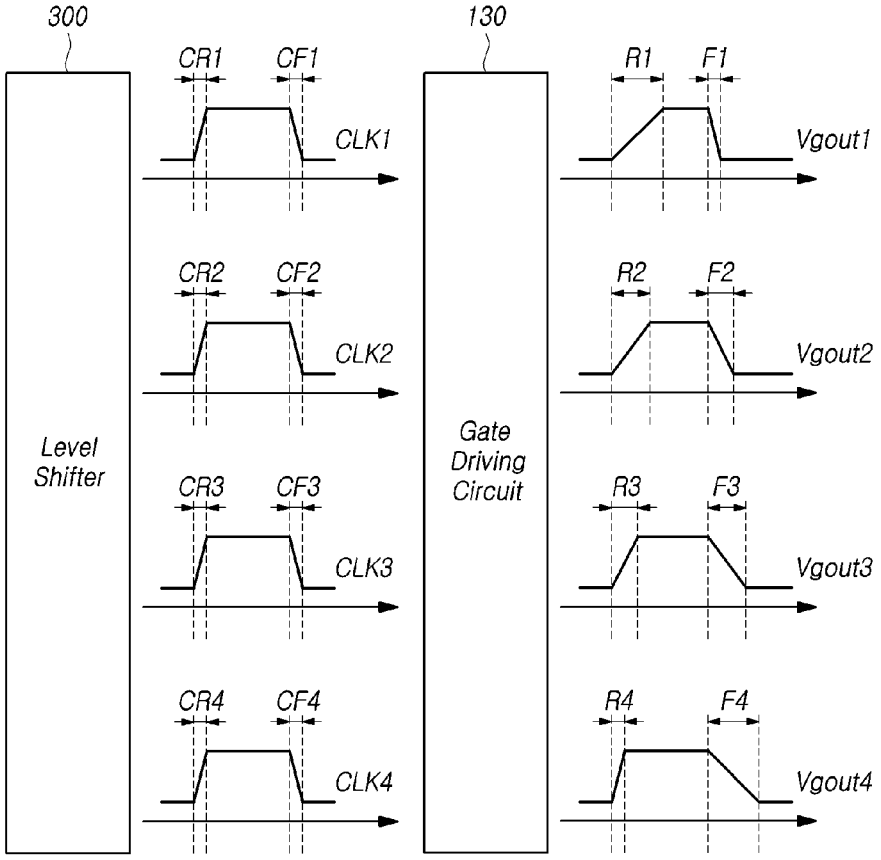
FIG. 19 is a diagram illustrating a characteristic deviation between gate signals output from the gate driving circuit of FIG. 18 according to embodiments of the present disclosure.
Figure 20:
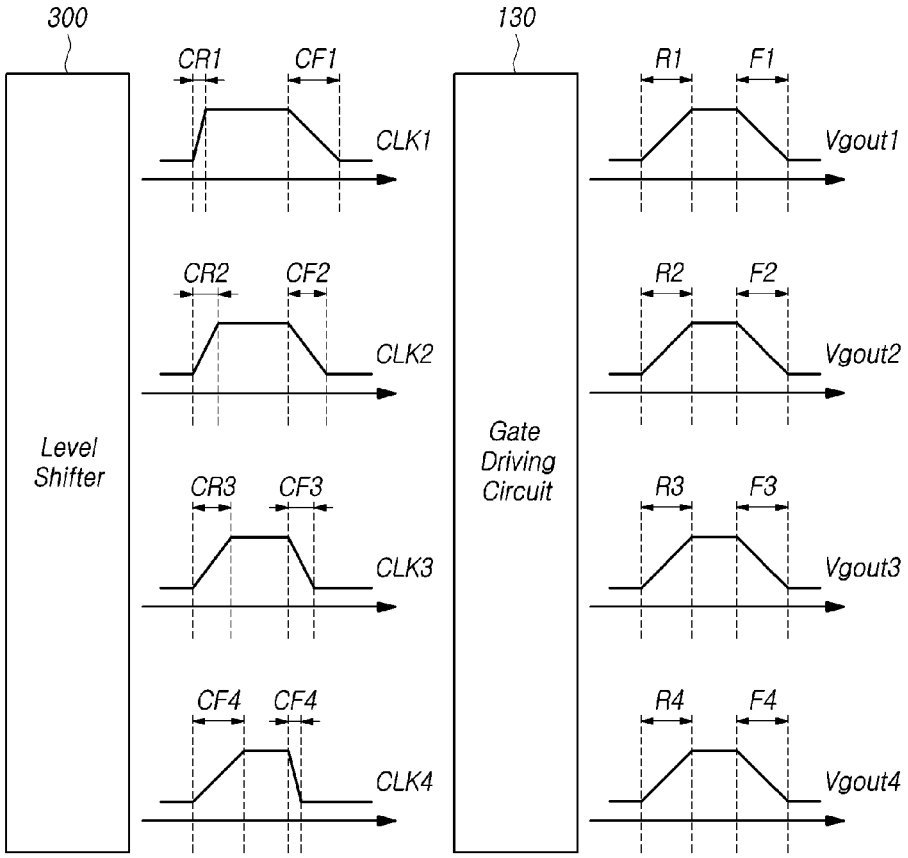
FIG. 20 is a diagram for explaining a characteristic deviation compensation function between gate signals output from the gate driving circuit of FIG. 18 according to embodiments of the present disclosure.

FIG. 19 is a diagram illustrating a characteristic deviation between gate signals output from the gate driving circuit 130 of FIG. 18 according to one embodiment. FIG. 20 is a diagram for explaining a characteristic deviation compensation function between gate signals output from the gate driving circuit 130 of FIG. 18 according to one embodiment.

Referring to FIG. 19, the level shifter 300 may output first to fourth clock signals CLK1 to CLK4 having the same signal waveform and signal characteristics. The gate driving circuit 130 may output first to fourth gate signals Vgout1 to Vgout4 by using the first to fourth clock signals CLK1 to CLK4 input from the level shifter 300.

As described above, when the gate driving circuit 130 performs overlap gate driving and has a Q node sharing structure without performing a clock signal control function to compensate for characteristic deviation between gate signals, characteristic deviation between gate signals may occur.

Not performing the clock signal control function to compensate for the characteristic deviation between the gate signals may mean that the first to fourth clock signals CLK1 to CLK4 have the same signal waveform. The fact that the first to fourth clock signals CLK1 to CLK4 have the same signal waveform means that the rising characteristics (rising length) and falling characteristics (falling length) of the first to fourth clock signals CLK1 to CLK4 are the same.

Referring to FIG. 19, among the first to fourth gate signals Vgout1 to Vgout4, the turn-on voltage level section of the first gate signal Vgout1 proceeds at the earliest timing, and the turn-on voltage level section of the fourth gate signal Vgout4 may proceed at the slowest timing. In this case, the rising length R1 of the turn-on voltage level section of the first gate signal Vgout1 among the first to fourth gate signals Vgout1 to Vgout4 may be the longest. That is, the rising characteristic of the first gate signal Vgout1 among the first to fourth gate signals Vgout1 to Vgout4 may be the worst.

The falling length R4 in the turn-on voltage level section of the fourth gate signal Vgout4 among the first to fourth gate signals Vgout1 to Vgout4 may be the longest. That is, the falling characteristic of the fourth gate signal Vgout4 among the first to fourth gate signals Vgout1 to Vgout4 may be the worst.

Comparing the rising characteristics (rising length) of each of the first to fourth gate signals Vgout1 to Vgout4, the rising characteristic of the first gate signal Vgout1 may be the worst, and the rising characteristic of the fourth gate signal Vgout4 may be the best. The rising characteristic of the second gate signal Vgout2 may be the second worst, and a rising characteristic of the third gate signal Vgout3 may be third worst. That is, the rising length R1 of the first gate signal Vgout1 may be the longest, and the rising length R4 of the fourth gate signal Vgout4 may be the shortest. The rising length R2 of the second gate signal Vgout2 may be the second longest, and the rising length R3 of the third gate signal Vgout3 may be the third longest (R1>R2>R3>R4).

However, it does not change that the rising length R1 of the first gate signal Vgout1 is the longest among the first to fourth gate signals Vgout1 to Vgout4, and the magnitude relationship of the rising lengths R2, R3, and R4 between the second to fourth gate signals Vgout2 to Vgout4 may be variously changed.

When comparing the falling characteristics (falling length) of each of the first to fourth gate signals (Vgout1 to Vgout4), the falling characteristic of the fourth gate signal Vgout4 may be the worst, and the falling characteristic of the first gate signal Vgout1 may be the best. The falling characteristic of the third gate signal Vgout3 may be the second worst, and the falling characteristic of the second gate signal Vgout2 may be the third worst. That is, the falling length F4 of the fourth gate signal Vgout4 may be the longest, and the falling length F1 of the first gate signal Vgout1 may be the shortest. The falling length F3 of the third gate signal Vgout3 may be the second longest, and the falling length F2 of the second gate signal Vgout2 may be the third longest (F1<F2<F3<F4).

However, it does not change that the falling length F4 of the fourth gate signal Vgout4 is the longest among the first to fourth gate signals Vgout1 to Vgout4, and the magnitude relationship of the falling lengths F1, F2, and F3 between the first to third gate signals Vgout1 to Vgout3 may vary.

In order to reduce the characteristic deviation between the first to fourth gate signals Vgout1 to Vgout4, that is, to compensate for the characteristic deviation between the gate signals, the level shifter 300 may perform a clock signal control function. Here, the characteristic deviation may include a rising characteristic deviation and a falling characteristic deviation.

Referring to FIG. 20, in order to reduce a characteristic deviation between the first to fourth gate signals Vgout1 to Vgout4, the level shifter 300 may control signal characteristics of one or more of the first to fourth clock signals CLK1 to CLK4. Here, the signal characteristic may include at least one of a rising characteristic and a falling characteristic. For example, the level shifter 300 may control the respective falling lengths CF1, CF2, and CF3 of the first to third clock signals CLK1 to CLK3 to become longer.

Accordingly, the falling lengths F1, F2, and F3 of each of the first, second and third gate signals Vgout1, Vgout2, and Vgout3 may be similar to the falling length F4 of the fourth gate signal Vgout4 having the worst falling characteristics.

Referring to FIG. 20, a turn-on level voltage section of the first gate signal Vgout1 and a turn-on level voltage section of the second gate signal Vgout2 may overlap. The turn-on level voltage section of the second gate signal Vgout2 and a turn-on level voltage section of the third gate signal Vgout3 may overlap. And the turn-on level voltage section of the third gate signal Vgout3 and a turn-on level voltage section of the fourth gate signal Vgout4 may overlap.

Referring to FIG. 20, the first gate signal Vgout1 may have a turn-on level voltage section at a faster timing than the last fourth gate signal Vgout4 among the first to fourth gate signals Vgout1 to Vgout4. In this case, the falling length CF1 of the first clock signal CLK1 may be longer than the falling length CF4 of the fourth clock signal CLK4, or the rising length CR4 of the fourth clock signal CLK4 may be longer than the rising length CR1 of the first clock signal CLK1. It will be explained again below.

Referring to FIG. 20, as long as the falling length CF4 of the fourth clock signal CLK4 is the shortest, the magnitude relation of the respective falling lengths CF1 to CF3 of the first to third clock signals CLK1 to CLK3 may be changed.

Referring to FIG. 20, for example, the falling length CF4 of the fourth clock signal CLK4 is the shortest, the falling length CF3 of the third clock signal CLK3 is the second shortest, the falling length CF2 of the second clock signal CLK2 is the third shortest, and the falling length CF1 of the first clock signal CLK1 may be the longest (CF4<CF3<CF2<CF1).

Referring to FIG. 20, in order to reduce the characteristic deviation (rising characteristic deviation, falling characteristic deviation) between the first to fourth gate signals Vgout1 to Vgout4, the level shifter 300 may control the rising lengths CR2 to CR4 of each of the second to fourth clock signals CLK2 to CLK4 to be longer. Accordingly, the rising lengths R2 to R4 of each of the second to fourth gate signals Vgout2 to Vgout4 may be similar to the rising length R1 of the first gate signal Vgout1 having the worst rising characteristic.

Referring to FIG. 20, as long as the rising length CR1 of the first clock signal CLK1 is the shortest, the magnitude relation of the rising lengths CR2 to CR4 of the second to fourth clock signals CLK2 to CLK4 may be changed.

Referring to FIG. 20, for example, the rising length CR1 of the first clock signal CLK1 may be the shortest, the rising length CR2 of the second clock signal CLK2 is the second shortest, the rising length CR3 of the third clock signal CLK3 is the third shortest, and the rising length CR4 of the fourth clock signal CLK4 may be the longest (CR1<CR2<CR3<CR4).

Figure 21:
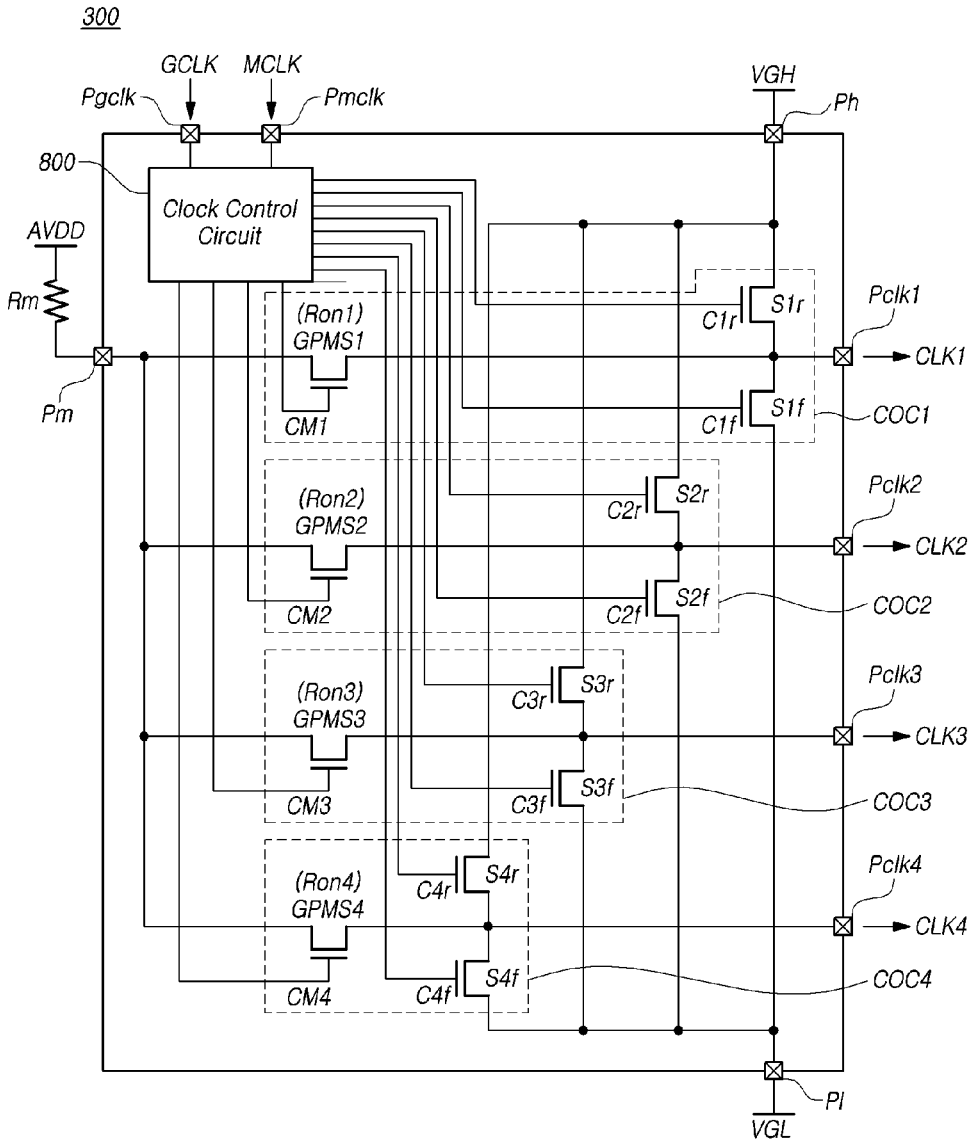
FIG. 21 is the level shifter according to embodiments of the present disclosure.

FIG. 21 is the level shifter 300 according to embodiments of the present disclosure.

The level shifter 300 according to embodiments of the present disclosure illustrated in FIG. 21 is for a gate driving circuit 130 having a Q node sharing structure in which four gate output buffers GBUF1 to GBUF4 share one Q node.

The structure of the level shifter 300 of FIG. 21 is an extension of the structure of the level shifter 300 of FIG. 8, and may have the same structural concept as the structure of the level shifter 300 of FIG. 8. The operation of the level shifter 300 of FIG. 21 is an extension of the operation of the level shifter 300 of FIG. 8, and may have the same concept as the operation of the level shifter 300 of FIG. 8. Here, the level shifter 300 of FIG. 21 is for the gate driving circuit 130 has a Q node sharing structure in which four gate output buffers GBUF1 to GBUF4 share one Q node. The level shifter 300 of FIG. 8 is for gate driving circuit 130 having a Q node sharing structure in which two gate output buffers GBUF1 and GBUF2 share one Q node.

Since the level shifter 300 of FIG. 21 generates and outputs four clock signals CLK1 to CLK4, the number of output terminals and the number of clock output circuits is different, and the remaining structure is the same as that of the level shifter 300 of FIG. 8.

Referring to FIG. 21, the level shifter 300 according to embodiments of the present disclosure may include: input terminals Ph, Pl, Pm, Pgclk, and Pmclk; output terminals Pclk1, Pclk2, Pclk3, and Pclk4; first to fourth clock output circuits COC1 to COC4 configured to output the first to fourth clock signals CLK1 to CLK4, respectively; and a clock control circuit 800 configured to control the first to fourth clock output circuits COC1 to COC4.

Referring to FIG. 21, the first clock output circuit COC1 may include: a first rising switch S1*r* for controlling the electrical connection between the high input terminal Ph and the first output terminal Pclk1; a first falling switch S1*f* for controlling the electrical connection between the low input terminal Pl and the first output terminal Pclk1; and a first gate pulse modulation switch GPMS1 for controlling an electrical connection between the intermediate input terminal Pm and the first output terminal Pclk1.

Referring to FIG. 21, the second clock output circuit COC2 may include: a second rising switch S2*r* for controlling an electrical connection between the high input terminal Ph and the second output terminal Pclk2; a second falling switch S2*f* controlling the electrical connection between the low input terminal Pl and the second output terminal Pclk2; and a second gate pulse modulation switch GPMS2 for controlling the electrical connection between the intermediate input terminal Pm and the second output terminal Pclk2.

Referring to FIG. 21, the third clock output circuit COC3 may include the third rising switch S3*r* for controlling an electrical connection between the high input terminal Ph and the third output terminal Pclk3, the third falling switch S3*f* controlling the electrical connection between the low input terminal Pl and the third output terminal Pclk3, and the third gate pulse modulation switch GPMS3 for controlling the electrical connection between the intermediate input terminal Pm and the third output terminal Pclk3.

Referring to FIG. 21, the fourth clock output circuit COC4 may include a fourth rising switch S4*r* for controlling the electrical connection between the high input terminal Ph and the fourth output terminal Pclk4, a fourth falling switch S4*f* that controls the electrical connection between the low input terminal Pl and the fourth output terminal Pclk4, and a fourth gate pulse modulation switch GPMS4 for controlling the electrical connection between the intermediate input terminal Pm and the fourth output terminal Pclk4.

Referring to FIG. 21, the clock control circuit 800 may output a first rising control signal C1*r* for controlling the switching operation of the first rising switch S1*r*, a first falling control signal C1*f* for controlling the switching operation of the first falling switch S1*f*, and a first intermediate control signal CM1 for controlling a switching operation of the first gate pulse modulation switch GPMS1. The clock control circuit 800 may output a second rising control signal C2*r* for controlling the switching operation of the second rising switch S2*r*, a second falling control signal C2*f* for controlling the switching operation of the second falling switch S2*f*, and a second intermediate control signal CM2 for controlling a switching operation of the second gate pulse modulation switch GPMS2.

Referring to FIG. 21, the clock control circuit 800 may output a third rising control signal C3*r* for controlling the switching operation of the third rising switch S3*r*, a third falling control signal C3*f* for controlling the switching operation of the third falling switch S3*f*, and a third intermediate control signal CM3 for controlling the switching operation of the third gate pulse modulation switch GPMS3. The clock control circuit 800 may output a fourth rising control signal C4*r* for controlling the switching operation of the fourth rising switch S4*r*, a fourth falling control signal C4*f* for controlling the switching operation of the fourth falling switch S4*f*, and a fourth intermediate control signal CM4 for controlling the switching operation of the fourth gate pulse modulation switch GPMS4.

Meanwhile, each of the first to fourth gate pulse modulation switches GPMS1 to GPMS3, the first to fourth rising switches S1*r* to S4*r*, and the first to fourth falling switches S1*f* to S4*f* may have an on-resistance. Here, the on-resistance of the switch is a resistance that prevents the flow of current flowing through the switch when a control signal (gate voltage) capable of turning on the switch is applied to the switch.

The on-resistances Ron1 to Ron4 of the first to fourth gate pulse modulation switches GPMS1 to GPMS4 may be greater than the on-resistances of the first to fourth rising switches S1*r* to S4*r*. The on-resistances Ron1 to Ron4 of the first to fourth gate pulse modulation switches GPMS1 to GPMS4 may be greater than the on-resistances of the first to fourth falling switches S1*f* to S4*f*.

Each of the on-resistances Ron1 to Ron4 of the first to fourth gate pulse modulation switches GPMS1 to GPMS4 included in the level shifter 300 according to embodiments of the present disclosure may be independently adjusted. Each of the on-resistances Ron1 to Ron4 of the first to fourth gate pulse modulation switches GPMS1 to GPMS4 included in the level shifter 300 according to embodiments of the present disclosure may be independently adjusted during the rising period and/or the falling period of the first to fourth clock signals CLK1 to CLK4.

In addition, in the level shifter 300 according to embodiments of the present disclosure, the on-resistance of the first to fourth rising switches S1*r* to S4*r* can be independently adjusted, or the on-resistance of the first to fourth falling switches S1*f* to S4*f* can be independently adjusted.

The level shifter 300 according to embodiments of the present disclosure may further include the first gate pulse modulation switch GPMS1 associated with the generation of the first clock signal CLK1, the second gate pulse modulation switch GPMS2 associated with the generation of the second clock signal CLK2, the third gate pulse modulation switch GPMS3 associated with the generation of the third clock signal CLK3, and the fourth gate pulse modulation switch GPMS4 associated with the generation of the fourth clock signal CLK4. In this respect, the level shifter 300 according to embodiments of the present disclosure has a unique feature.

Figure 22:
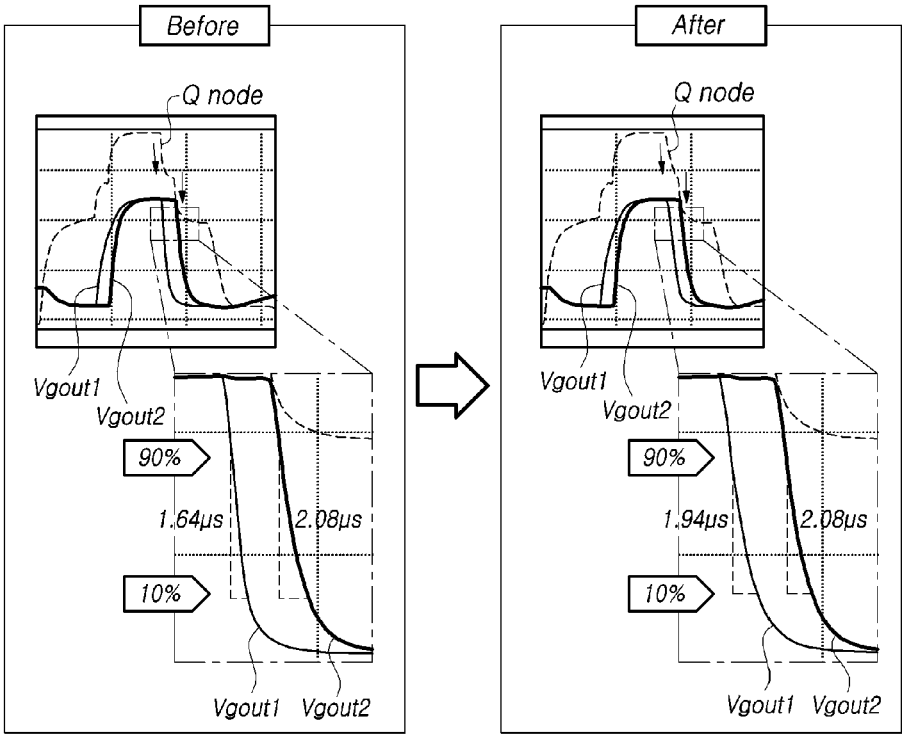
FIG. 22 is a graph for explaining an effect of the characteristic deviation compensation function between gate signals under the Q node sharing structure as shown in FIG. 5 in the display device according to embodiments of the present disclosure.

FIG. 22 is a graph for explaining an effect of the characteristic deviation compensation function between gate signals Vgout1 and Vgout2 under the Q node sharing structure as shown in FIG. 5 in the display device 100 according to embodiments of the present disclosure.

FIG. 22 is a graph showing the first gate signal Vgout1, the second gate signal Vgout2, and the Q node voltage before and after applying the characteristic deviation compensation control between the gate signals Vgout1 and Vgout2 under the Q node sharing structure as shown in FIG. 5.

Referring to FIG. 22, before applying the characteristic deviation compensation control between the gate signals, the falling characteristics of the first and second gate signals Vgout1 and Vgout2 are as follows. However, the falling length is the difference between the time when the voltage level becomes 90% of the voltage level before falling and the time when the voltage level becomes 10% of the voltage level before falling.

Referring to FIG. 22, before applying the characteristic deviation compensation control between the gate signals, the falling length of the first gate signal Vgout1 is 1.64 μs, and the falling length of the second gate signal Vgout2 is 2.08 μs.

Referring to FIG. 22, before applying the characteristic deviation compensation control between the gate signals, the falling length difference (falling deviation) between the first gate signal Vgout1 and the second gate signal Vgout2 is 0.44 μs (=2.08 μs−1.64 μs).

In the effect verification simulation, only the falling control that lengthens the falling length CF1 of the first clock signal CLK1 was applied when the characteristic deviation compensation control between the gate signals was applied.

Referring to FIG. 22, the falling characteristic of the first gate signal Vgout1 after applying the characteristic deviation compensation control between the gate signals is as follows. In the falling process of the first gate signal Vgout1, the difference between the time when the voltage level becomes 90% of the voltage level before falling and the time when the voltage level becomes 10% of the voltage level before falling is measured as the falling length. The measured falling length is 1.94 μs. This is longer than 1.64 μs, which is the falling length before applying the characteristic deviation compensation control between gate signals.

Referring to FIG. 22, the falling characteristic of the second gate signal Vgout2 after applying the characteristic deviation compensation control between the gate signals does not change as follows. In the falling process of the second gate signal Vgout2, the difference between the time when the voltage level becomes 90% of the voltage level before falling and the time when the voltage level becomes 10% of the voltage level before falling is measured as the falling length do. The measured falling length is 2.08 μs.

Referring to FIG. 22, after applying the characteristic deviation compensation control between the gate signals, the falling length difference (falling deviation) between the first gate signal Vgout1 and the second gate signal Vgout2 is 0.14 μs (=2.08 μs−1.94 μs). This is a significantly reduced value than 0.44 μs, which is the falling length difference before applying the characteristic deviation compensation control between gate signals.

Therefore, through the falling control of the first clock signal CLK1, it is possible to reduce the deviation of the falling characteristics between the first gate signal Vgout1 and the second gate signal Vgout2.

Figure 23:
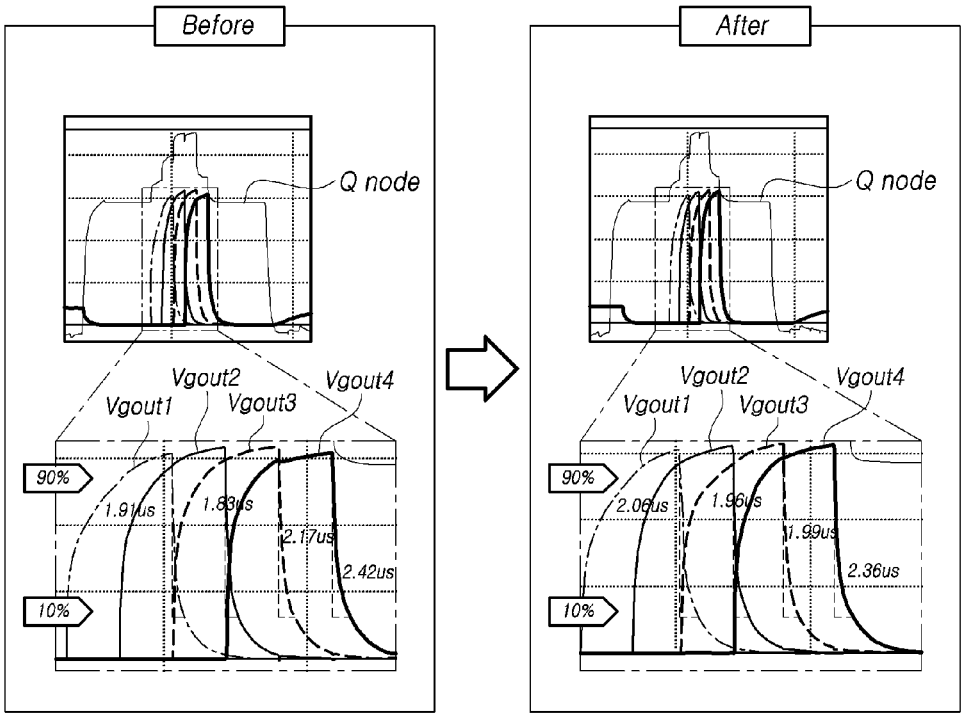
FIG. 23 is a diagram for explaining an effect of a characteristic deviation compensation function between gate signals under the Q node sharing structure as shown in FIG. 18 in the display device according to embodiments of the present disclosure.

FIG. 23 is a diagram for explaining an effect of a characteristic deviation compensation function between gate signals Vgout1, Vgout2, Vgout3, and Vgout4 under the Q node sharing structure as shown in FIG. 18 in the display device 100 according to embodiments of the present disclosure.

FIG. 23 is a graph illustrating first to fourth gate signals Vgout1 to Vgout4 and Q node voltages before and after applying the characteristic deviation compensation control between the first to fourth gate signals Vgout1 to Vgout4 under the Q node sharing structure as shown in FIG. 18.

Referring to FIG. 23, before applying the characteristic deviation compensation control between the gate signals, the falling characteristics of the first to fourth gate signals Vgout1 to Vgout4 are as follows. However, the falling length is the difference between the time when the voltage level becomes 90% of the voltage level before falling and the time when the voltage level becomes 10% of the voltage level before falling.

Referring to FIG. 23, before applying the characteristic deviation compensation control between the gate signals, the falling length of the first gate signal Vgout1 is 1.91 μs. The falling length of the second gate signal Vgout2 is 1.83 μs. The falling length of the third gate signal Vgout3 is 2.17 μs. Furthermore, the falling length of the fourth gate signal Vgout4 is 2.42 μs.

Referring to FIG. 23, before applying the characteristic deviation compensation control between the gate signals, the maximum falling length difference (maximum falling deviation) between the first to fourth gate signals Vgout1 to Vgout4 is 0.59 μs (=2.42 μs−1.83 μs).

In the effect verification simulation, for the compensation control of the characteristic deviation between the gate signals, the falling control was applied. Accordingly, the falling length CF1 of the first clock signal CLK1 is the longest, the falling length CF2 of the second clock signal CLK2 becomes the second longest, and the falling length CF3 of the third clock signal CLK3 becomes the third longest.

Referring to FIG. 23, after applying the characteristic deviation compensation control between the gate signals, the falling characteristics of the first to fourth gate signals Vgout1 to Vgout4 are as follows.

Referring to FIG. 23, after applying the characteristic deviation compensation control between the gate signals, the falling length of the first gate signal Vgout1 is 2.061 μs, the falling length of the second gate signal Vgout2 is 1.96 μs, the falling length of the third gate signal Vgout3 is 1.99 μs, and the falling length of the fourth gate signal Vgout4 is 2.36 μs.

Referring to FIG. 23, after applying the characteristic deviation compensation control between the gate signals, the maximum falling length difference (maximum falling deviation) between the first to fourth gate signals Vgout1 to Vgout4 is 0.40 μs (=2.36 μs−1.96 μs). This is a significantly reduced value than 0.59 μs, which is the falling length difference before applying the characteristic deviation compensation control between gate signals.

Accordingly, through the falling control of the first to fourth clock signals CLK1 to CLK4, it is possible to reduce the deviation in the falling characteristics between the first to fourth gate signals Vgout1 to Vgout4.

According to embodiments of the present disclosure, it is possible to provide the level shifter 300 and the display device 100 that can reduce a characteristic variation between gate signals and thereby improve image quality.

According to embodiments of the present disclosure, it is possible to provide the level shifter 300 and the display device 100 capable of variously controlling a rising characteristic and/or a falling characteristic of clock signals.

According to embodiments of the present disclosure, it is possible to provide the level shifter 300 and the display device 100 capable of reducing the size of an arrangement area of the gate driving circuit 130 and reducing characteristic variation between gate signals even if the gate driving circuit is disposed on the display panel 110 in a panel built-in type.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A level shifter comprising:

a first output terminal outputting a first clock signal;

a second output terminal outputting a second clock signal having a different rising length or a different falling length than a rising length or a falling length of the first clock signal, respectively;

a high input terminal to which a high level voltage is input;

a low input terminal to which a low level voltage is input, the low level voltage less than the high level voltage;

an intermediate input terminal to which an intermediate level voltage is input, the intermediate level voltage less than the high level voltage and greater than the low level voltage;

a first clock output circuit including a first rising switch configured to control an electrical connection between the high input terminal and the first output terminal, a first falling switch configured to control an electrical connection between the low input terminal and the first output terminal, and a first gate pulse modulation switch configured to control an electrical connection between the intermediate input terminal and the first output terminal; and a second clock output circuit including a second rising switch configured to control an electrical connection between the high input terminal and the second output terminal, a second falling switch configured to control an electrical connection between the low input terminal and the second output terminal, and a second gate pulse modulation switch configured to control an electrical connection between the intermediate input terminal and the second output terminal.

2. The level shifter of claim 1, wherein an on-resistance of the first gate pulse modulation switch is greater than an on-resistance of the first rising switch and an on-resistance of the first falling switch, and wherein an on-resistance of the second gate pulse modulation switch is greater than an on-resistance of the second rising switch and an on-resistance of the second falling switch.

3. The level shifter of claim 1, wherein a falling length of the first clock signal is longer than a falling length of the second clock signal.

4. The level shifter of claim 1, wherein an on-resistance of the first gate pulse modulation switch when the first clock signal falls from a first level to a second level that is less than the first level is greater than an on-resistance of the second gate pulse modulation switch when the second clock signal falls from the first level to the second level.

5. The level shifter of claim 1, wherein an on-resistance of the first falling switch when the first clock signal falls is greater than an on-resistance of the second falling switch when the second clock signal falls.

6. The level shifter of claim 1, wherein a rising length of the second clock signal is longer than a rising length of the first clock signal.

7. The level shifter of claim 1, wherein an on-resistance of the second gate pulse modulation switch when the second clock signal rises is greater than an on-resistance of the first gate pulse modulation switch when the first clock signal rises.

8. The level shifter of claim 1, wherein an on-resistance of the second rising switch when the second clock signal rises is greater than an on-resistance of the first rising switch when the first clock signal rises.

9. The level shifter of claim 1, wherein an on-resistance of the first gate pulse modulation switch when the first clock signal falls is greater than the on-resistance of the first gate pulse modulation switch when the first clock signal rises.

10. The level shifter of claim 1, wherein an on-resistance of the second gate pulse modulation switch when the second clock signal rises is greater than the on-resistance of the second gate pulse modulation switch when the second clock signal falls.

11. The level shifter of claim 1, further comprising a clock control circuit configured to control the first clock output circuit and the second clock output circuit based on a generation clock signal and a modulation clock signal, wherein the clock control circuit is configured to output control signals for controlling an on state or an off state of each of the first rising switch, the first falling switch, and the first gate pulse modulation switch based on a first pulse of the generation clock signal and a first pulse of the modulation clock signal, and wherein the clock control circuit is configured to output control signals for controlling an on state or an off state of each of the second rising switch, the second falling switch, and the second gate pulse modulation switch based on a second pulse of the generation clock signal and a second pulse of the modulation clock signal.

12. The level shifter of claim 1, wherein the first gate pulse modulation switch includes two or more first sub-switches connected in parallel between the intermediate input terminal and the first output terminal, and an on state or off state of the two or more first sub-switches are independently controlled, wherein an on-resistance of the first gate pulse modulation switch is in inverse proportion to a number of turned-on first sub-switches among the two or more first sub-switches, wherein the second gate pulse modulation switch includes two or more second sub-switches connected in parallel between the intermediate input terminal and the second output terminal, and wherein an on-resistance of the second gate pulse modulation switch is in inverse proportion to a number of turned-on second sub-switches among the two or more second sub-switches.

13. The level shifter of claim 1, further comprising a clock control circuit configured to control a first gate voltage and a second gate voltage, wherein the first gate voltage is a control signal for controlling an on state or an off state of the first gate pulse modulation switch, and the second gate voltage is a control signal for controlling an on state or an off state of the second gate pulse modulation switch, and wherein an on-resistance of the first gate pulse modulation switch is changed according to the first gate voltage, and an on-resistance of the second gate pulse modulation switch is changed according to the second gate voltage.

14. The level shifter of claim 1, wherein a rising of the first clock signal includes a first rising period in which the voltage of the first clock signal is changed from the low level voltage to the intermediate level voltage by the first gate pulse modulation switch and a second rising period subsequent to the first rising period in which the voltage of the first clock signal is changed from the intermediate level voltage to the high level voltage by the first rising switch, and wherein a falling of the first clock signal includes a first falling period in which the voltage of the first clock signal is changed from the high level voltage to the intermediate level voltage or a voltage greater than the intermediate level voltage by the first gate pulse modulation switch and a second falling period subsequent to the first falling period in which the voltage of the first clock signal is changed from the intermediate level voltage or the voltage greater than the intermediate level voltage to the low level voltage by the first falling switch.

15. The level shifter of claim 1, wherein a rising of the second clock signal includes a first rising period in which the voltage of the second clock signal is changed from the low level voltage to the intermediate level voltage or a voltage less than the intermediate level voltage by the second gate pulse modulation switch and a second rising period subsequent to the first rising period in which the voltage of the second clock signal is changed from the intermediate level voltage or the voltage less than the intermediate level voltage to the high level voltage by the second rising switch, and wherein the falling of the second clock signal includes a first falling period in which the voltage of the second clock signal is changed from the high level voltage to the intermediate level voltage by the second gate pulse modulation switch and a second falling period subsequent to the first falling period in which the voltage of the second clock signal is changed from the intermediate level voltage to the low level voltage by the second falling switch.

16. The level shifter of claim 1, further comprising:

a third output terminal outputting a third clock signal having a different rising length or a different falling length than the first and second clock signals;

a fourth output terminal outputting a fourth clock signal having a different rising length or a different falling length than the first, second and third clock signals;

a third clock output circuit including a third rising switch for controlling an electrical connection between the high input terminal and the third output terminal, a third falling switch for controlling an electrical connection between the low input terminal and the third output terminal, and a third gate pulse modulation switch for controlling an electrical connection between the intermediate input terminal and the third output terminal; and a fourth clock output circuit including a fourth rising switch for controlling an electrical connection between the high input terminal and the fourth output terminal, a fourth falling switch controlling an electrical connection between the low input terminal and the fourth output terminal, and a fourth gate pulse modulation switch for controlling an electrical connection between the intermediate input terminal and the fourth output terminal.

17. A display device comprising:

a substrate;

a plurality of gate lines disposed on the substrate; and a gate driving circuit disposed on or connected to the substrate and configured to output a first gate signal and a second gate signal to a first gate line and a second gate line among the plurality of gate lines based on a first clock signal and a second clock signal, wherein the gate driving circuit comprises:

a first gate output buffer circuit configured to output the first gate signal based on the first clock signal;

a second gate output buffer circuit configured to output the second gate signal based on the second clock signal; and a gate output control circuit configured to control the first gate output buffer circuit and the second gate output buffer circuit, wherein the first gate output buffer circuit comprises:

a first pull-up transistor connected between a first clock input terminal to which the first clock signal is input and a first gate output terminal to which the first gate signal is output; and a first pull-down transistor connected between the first gate output terminal and a base input terminal to which a base voltage is input, wherein the second gate output buffer circuit comprises:

a second pull-up transistor connected between a second clock input terminal to which the second clock signal is input and a second gate output terminal to which the second gate signal is output; and a second pull-down transistor connected between the second gate output terminal and a base input terminal to which a base voltage is input, wherein a gate node of the first pull-up transistor and a gate node of the second pull-up transistor are electrically connected, wherein a gate node of the first pull-down transistor and a gate node of the second pull-down transistor are electrically connected, and wherein a falling length of the first clock signal is different from a falling length of the second clock signal, or a rising length of the second clock signal is different from a rising length of the first clock signal.

18. The display device of claim 17, wherein the falling length of the first clock signal is longer than the falling length of the second clock signal.

19. The display device of claim 18, wherein a difference between a falling length of the first gate signal and a falling length of the second gate signal is less than a difference between the falling length of the first clock signal and the falling length of the second clock signal.

20. The display device of claim 18, further comprising a level shifter configured to output the first clock signal and the second clock signal, wherein the level shifter comprises:

a first output terminal outputting a first clock signal;

a second output terminal outputting a second clock signal having a different rising length or a different falling length than the first clock signal;

a high input terminal to which a high level voltage is input;

a low input terminal to which a low level voltage is input, the low level voltage less than the high level voltage;

an intermediate input terminal to which an intermediate level voltage is input, the intermediate level voltage less than the high level voltage and greater than the low level voltage;

a first clock output circuit including a first rising switch configured to control an electrical connection between the high input terminal and the first output terminal, a first falling switch configured to control an electrical connection between the low input terminal and the first output terminal, and a first gate pulse modulation switch configured to control an electrical connection between the intermediate input terminal and the first output terminal; and a second clock output circuit including a second rising switch configured to control an electrical connection between the high input terminal and the second output terminal, a second falling switch configured to control an electrical connection between the low input terminal and the second output terminal, and a second gate pulse modulation switch configured to control an electrical connection between the intermediate input terminal and the second output terminal.

* * * * *